US010059403B2

(12) United States Patent
Ye et al.

(10) Patent No.: US 10,059,403 B2
(45) **Date of Patent: *Aug. 28, 2018**

(54) TAPERED COLUMN DEEP DRAFT SEMI-SUBMERSIBLE (TCDD-SEMI)

(71) Applicants: Wei Ye, The Woodlands, TX (US); Zhihuang Alex Ran, Katy, TX (US); Jim Jianxun Li, Katy, TX (US)

(72) Inventors: Wei Ye, The Woodlands, TX (US); Zhihuang Alex Ran, Katy, TX (US); Jim Jianxun Li, Katy, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/410,674

(22) Filed: Jan. 19, 2017

(65) Prior Publication Data

US 2017/0129571 A1 May 11, 2017

Related U.S. Application Data

(63) Continuation of application No. 14/885,837, filed on Oct. 16, 2015, now Pat. No. 9,586,650.

(51) Int. Cl.

| | |
|---|---|
| ***B63B 1/10*** | (2006.01) |
| ***B63B 35/44*** | (2006.01) |
| ***B63B 43/06*** | (2006.01) |
| ***B63B 35/34*** | (2006.01) |
| *B63B 43/08* | (2006.01) |

(52) U.S. Cl.

CPC ..... *B63B 1/107* (2013.01); *B63B 35/34* (2013.01); *B63B 35/44* (2013.01); *B63B 35/4413* (2013.01); *B63B 43/06* (2013.01); *B63B 43/08* (2013.01); *B63B 2207/00* (2013.01)

(58) Field of Classification Search

CPC .... B63B 1/00; B63B 1/04; B63B 1/10; B63B 1/12; B63B 35/00; B63B 35/44; B63B 43/06

USPC ..... 114/264, 265

See application file for complete search history.

(56) References Cited

U.S. PATENT DOCUMENTS

| | | | | |
|---|---|---|---|---|
| 9,586,650 | B1 * | 3/2017 | Ye | B63B 1/107 |
| 2004/0040487 | A1 | 3/2004 | Kristensen et al. | |
| 2006/0260526 | A1 | 11/2006 | Kristensen et al. | |
| 2012/0111256 | A1 | 5/2012 | Xu | |

OTHER PUBLICATIONS

Office Action dated Aug. 29, 2016, for U.S. Appl. No. 14/885,837 (6 p.).

(Continued)

*Primary Examiner* — Lars A Olson

(74) *Attorney, Agent, or Firm* — Conley Rose, P.C.

(57) ABSTRACT

A semi-submersible offshore platform for operations in a body of water includes a buoyant hull configured to be at least partially submerged in the water. In addition, the platform includes an equipment deck coupled to the hull and configured to be positioned above the water. The hull includes a first vertical column and a second vertical column horizontally spaced from the first vertical column. Each column has a longitudinal axis, an upper end, a lower end, and a tapered section axially positioned between the upper end and the lower end. Further, the hull includes a horizontal pontoon having a longitudinal axis, a first end coupled to the lower end of the first column, and a second end coupled to the lower end of the second column.

22 Claims, 21 Drawing Sheets

(56) References Cited

OTHER PUBLICATIONS

Response to Office Action dated Aug. 29, 2016, for U.S. Appl. No. 14/885,837; Response dated Oct. 5, 2016 (10 p.).
Notice of Allowance dated Nov. 9, 2016, for U.S. Appl. No. 14/885,837 (7 p.).

* cited by examiner

TAPERED COLUMN DEEP DRAFT SEMI-SUBMERSIBLE (TCDD-SEMI)

CROSS-REFERENCE TO RELATED APPLICATIONS

This application is a continuation of U.S. application Ser. No. 14/885,837 filed Oct. 16, 2015, and entitled, "Tapered Column Deep Draft Semi-Submersible (TCDD-SEMI)," which is hereby incorporated herein by reference in its entirety for all purposes.

STATEMENT REGARDING FEDERALLY SPONSORED RESEARCH OR DEVELOPMENT

This invention was made with support from Guangdong Innovative and Entrepreneurial Research Team Program (No. 2013G058).

BACKGROUND

The disclosure relates generally to floating offshore structures. More particularly, the disclosure relates to buoyant semi-submersible offshore platforms for offshore drilling and production operations. Still more particular, the disclosure relates to the geometry of the hull, columns, and pontoons of semi-submersible offshore platforms.

Most conventional semi-submersible offshore platforms include a hull with sufficient buoyancy to support a work deck above the water. For example, FIGS. 1 and 2 illustrate a conventional semi-submersible platform 10 deployed in a body of water 11. Platform 10 includes a buoyant hull 20 and a topsides or deck 30 supported by hull 20 above the surface 12 of water 11. The hull 20 typically includes a plurality of vertical upstanding columns 21 and a plurality of horizontal pontoons 22 extending between columns 21. The deck 30 sits atop the upper ends of columns 21. In general, the size of the pontoons 22 and the number of columns 21 are governed by the size and weight of the deck 30 and equipment disposed on deck 30. As with most conventional semi-submersible platforms, each column 21 of platform 10 has a constant or uniform width $W_{21}$ in side view moving vertically between deck 30 and pontoons 22, and each pontoon 22 of platform 10 has a constant or uniform width $W_{22}$ in top view moving horizontally between adjacent columns 21.

The hull 20 is typically divided into several closed compartments, each compartment having a buoyancy that can be adjusted for purposes of flotation and trim. Typically, a pumping system pumps ballast water into and out of the compartments to adjust their buoyancy. The compartments are typically defined by horizontal and/or vertical bulkheads in the pontoons 22 and columns 21. Normally, the compartments of the pontoon 22 and the lower compartments of the columns 21 are filled with water ballast when the platform is in its operational configuration, and the upper compartments of the columns 21 provide buoyancy for the platform 10.

Typically, piping or risers are hung from the platform, and thus, the hull must be sufficiently buoyant to support the deck as well as any piping or risers. The relatively large heave (vertical) motions experienced by many conventional semi-submersible platforms usually dictate the use of steel "catenary" risers (SCRs) that extend between the platform and the seafloor, and the positioning of wellhead equipment such as the production tree at the sea-floor (i.e., a "wet" tree), rather than on the platform. The catenary shape of SCRs accommodate and absorb the large heave motions and horizontal motions of the floating semi-submersible platform.

The "draft" of a floating offshore structure is defined as the vertical distance measured from the waterline (i.e., the surface of the water) to the bottom of the hull. For example, in FIG. 2, semi-submersible platform 10 has a draft $D_{10}$ measured from the bottom of hull 20 to the surface 12. A semi-submersible offshore platform having a draft less than 100 ft. is typically described as "shallow" draft. Increasing the draft of a semi-submersible offshore platform can reduce heave motions (i.e., movement in the vertical direction) as the pontoons at a greater depth below the surface of the water where wave excitation forces are generally lower. Accordingly, semi-submersible platforms having a draft greater than 100 ft., often described as "deep" draft, usually experience smaller heave motions as compared to shallow draft semi-submersible platforms.

The draft of a semi-submersible platform is increased by lengthen the columns of the hull. Although this may reduce heave motions by positioning the pontoons at greater depths, longer columns are more susceptible to a phenomenon known in the art as "vortex-induced-motion" (VIM). In particular, a boundary layer forms close to the outer surface of a body exposed to a moving fluid due to viscous forces. Separation in the flow of the moving fluid occurs when the boundary layer reaches certain points behind a blunt body such as a column on a semi-submersible platform. The fluid flow becomes detached from the surface of the object and takes the form of eddies and vortices. Oscillating flow characterized by periodic vortex shedding may take place when the fluid flows past the body at certain velocities, depending on the size and shape of the body. The undesirable resonance motion of a moored floating platform caused by vortex shedding effects is called VIM "lock-in." On deep draft semi-submersible platforms with longer columns, VIM excitation forces are typically higher than those on conventional semi-submersibles with shorter columns, and hence, deep draft semi-submersible platforms are more likely to experience larger VIM motions and VIM lock-in. VIM is a significant contributor to fatigue damage of offshore structures such as platforms, mooring lines, and risers. In addition, VIM induced motions may render it more difficult to maintain the lateral position of the offshore platform over the well site and/or increase the likelihood of damaging riser systems.

The location of final assembly of a semi-submersible offshore platform may involve integration of the hull and topsides at the shipyard (i.e., quayside), at a nearshore location, or at the operation site (i.e., the location where drilling and/or production will occur). For quayside integration, the topsides is lifted and mounted to the hull with heavy lifting equipment (e.g., heavy lift crane) in the shipyard. For nearshore integration, the topsides is lifted and mounted to the hull with heavy lift cranes or heavy lift barge in the water close to the shore. For integration at the operation site, the hull is transported offshore to the operation site, either by towing it at a shallow draft, or by floating it aboard a heavy lift vessel. At the operation site, the hull is ballasted, and the topsides is then either lifted onto the tops of the columns by heavy lift cranes carried aboard a heavy lift barge, or by floating the work platform over the top of the partially submerged hull using a deck barge. In either case, the procedure is typically effected far offshore (e.g., 100 miles, or 161 km), is performed in open seas, and is strongly dependent on weather conditions and the availability of a heavy lift barge, making it both risky and expensive.

Quayside topsides integration in the shipyard is usually the safest and most economical among the three integration options. However, quayside water depths are usually on the order of about 30-35 ft., and thus, for quayside integration, the hull must provide sufficient buoyancy to support its own weight and topside weight while maintaining a draft less than 30-35 ft. It may be challenging to maintain such a shallow draft at the quayside location with semi-submersible platforms designed for deep draft deployment at the operation site—due to the lack of sufficient buoyancy provided by conventional semi-submersible platform geometries at this shallow draft.

After hull and topsides integrations quayside or near shore, the semi-submersible platform is transported to the operation site by wet tow or with a heavy transportation vessel. Both methods involve ballasting down the hull during pre-service operations. During the ballasting process, the stability of the floating structure typically decreases as the draft increases and the pontoons transition from being partially submerged to wholly submerged. This may be particularly problematic with deep draft semi-submersibles due to the length of the columns and the height of the topsides supported by the columns.

BRIEF SUMMARY OF THE DISCLOSURE

Embodiments of semi-submersible offshore platforms for offshore operations in a body of water are disclosed herein. In one embodiment, the platform comprises a buoyant hull configured to be at least partially submerged in the water. In addition, the platform comprises an equipment deck coupled to the hull and configured to be positioned above the water. The hull comprises a first vertical column and a second vertical column horizontally spaced from the first vertical column. Each column has a longitudinal axis, an upper end, a lower end, and a tapered section axially positioned between the upper end and the lower end. The upper end of each column has a width $W_1$ measured perpendicular to the longitudinal axis in side view, the lower end of each column has a width $W_2$ measured perpendicular to the longitudinal axis in side view, and the tapered section has a width $W_3$ measured perpendicular to the longitudinal axis in side view. The width $W_1$ of the upper end is less than the width $W_2$ of the lower end. The width $W_3$ of the tapered section increases moving axially downward along the tapered section. Further, the platform comprises a horizontal pontoon having a longitudinal axis, a first end coupled to the lower end of the first column, and a second end coupled to the lower end of the second column.

Embodiments of semi-submersible offshore platforms for offshore operations in a body of water are disclosed herein. In one embodiment, the platform comprises a buoyant hull having a vertical central axis and configured to be at least partially submerged in the water. In addition, the platform comprises an equipment deck coupled to the hull and configured to be positioned above the water. The hull comprises a plurality of circumferentially spaced vertical columns disposed about the central axis of the hull. Each column has a longitudinal axis, an upper end, a lower end, and a tapered section axially positioned between the upper end and the lower end of the column. The tapered section of each column comprises an outer surface oriented at an acute angle $\theta$ relative to the longitudinal axis of the column. The hull also comprises a plurality of horizontal pontoons. One pontoon extends between the lower ends of each pair of circumferentially adjacent columns.

Embodiments described herein comprise a combination of features and advantages intended to address various shortcomings associated with certain prior devices, systems, and methods. The foregoing has outlined rather broadly the features and technical advantages of the invention in order that the detailed description of the invention that follows may be better understood. The various characteristics described above, as well as other features, will be readily apparent to those skilled in the art upon reading the following detailed description, and by referring to the accompanying drawings. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

BRIEF DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Figure 1:
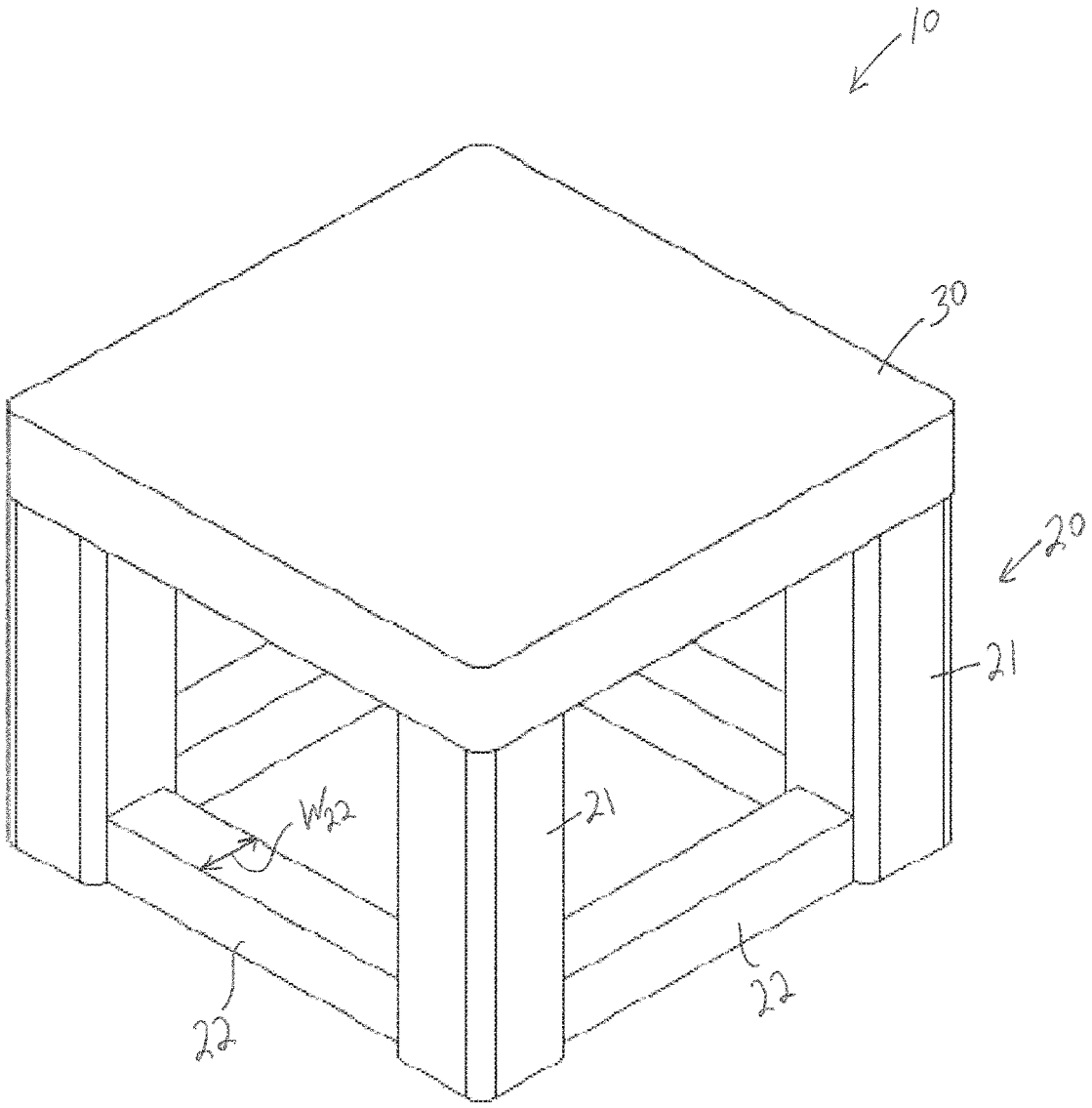
Figure 1 (Prior Art)
FIG. 1 is a perspective view of a conventional floating semi-submersible offshore platform.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis.

During drilling or production operations, it is generally desirable to minimize the motion of the offshore platform to maintain the position of the platform over the well site and to reduce the likelihood of damage to the risers. Deep draft semi-submersible platforms generally experience less heave motion than shallow draft semi-submersible platforms. However, the relatively long columns of deep draft semi-submersible platforms are more prone to undesirable vortex induced-motion (VIM) and VIM lock-in. In addition, quayside integration may be challenging for deep draft semi-submersible platforms due to shipyard draft limitations, and ballasting of deep draft semi-submersible platforms during deployment may present stability issues. Accordingly, there remain needs in the art for offshore semi-submersible platforms that reduce heave motions and VIM, while providing sufficient buoyancy during quayside construction and enhanced stability during deployment.

Figure 3:
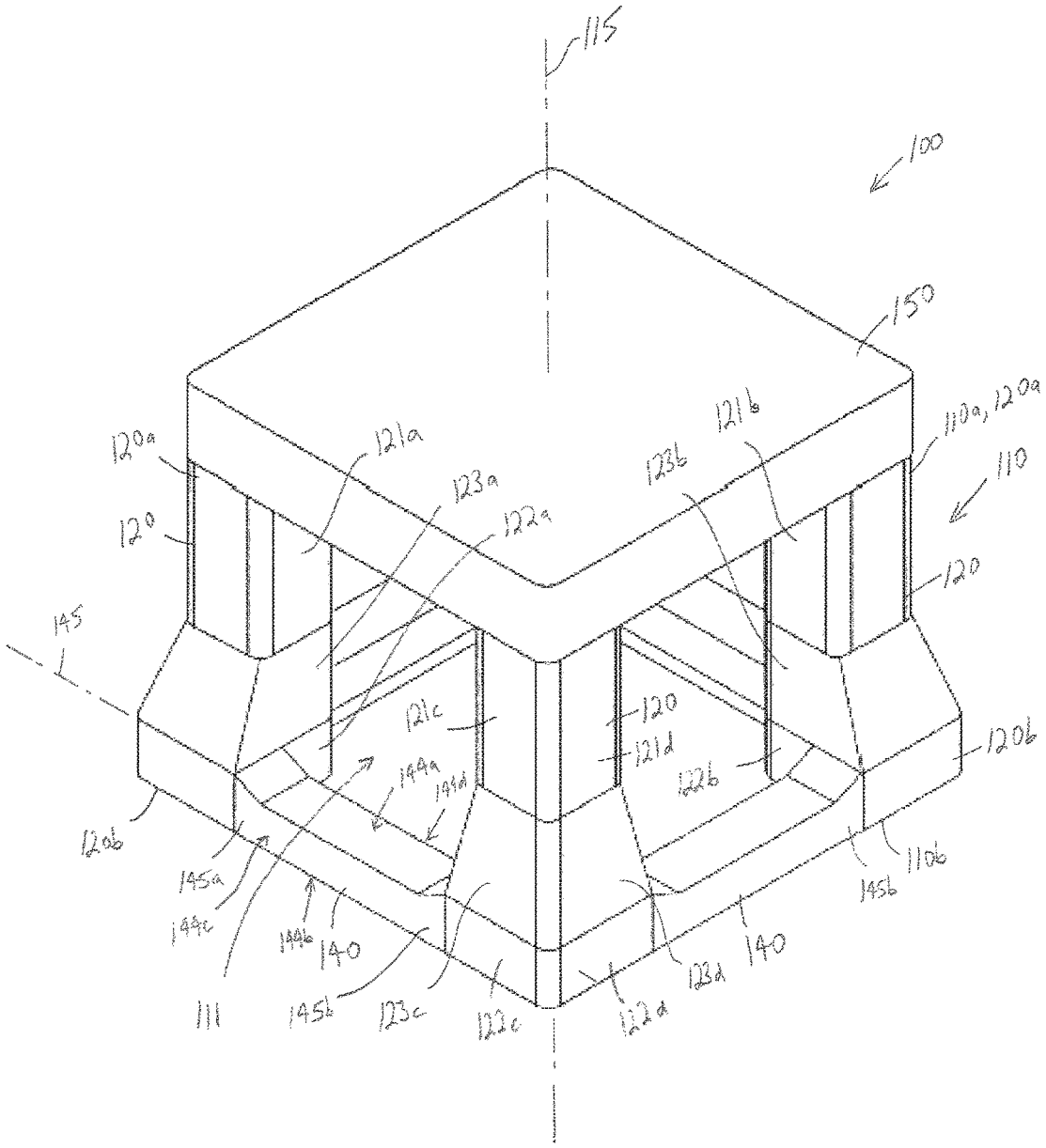
FIG. 3 is a perspective view of an embodiment of a floating semi-submersible offshore platform in accordance with the principles described herein.
Figure 4:
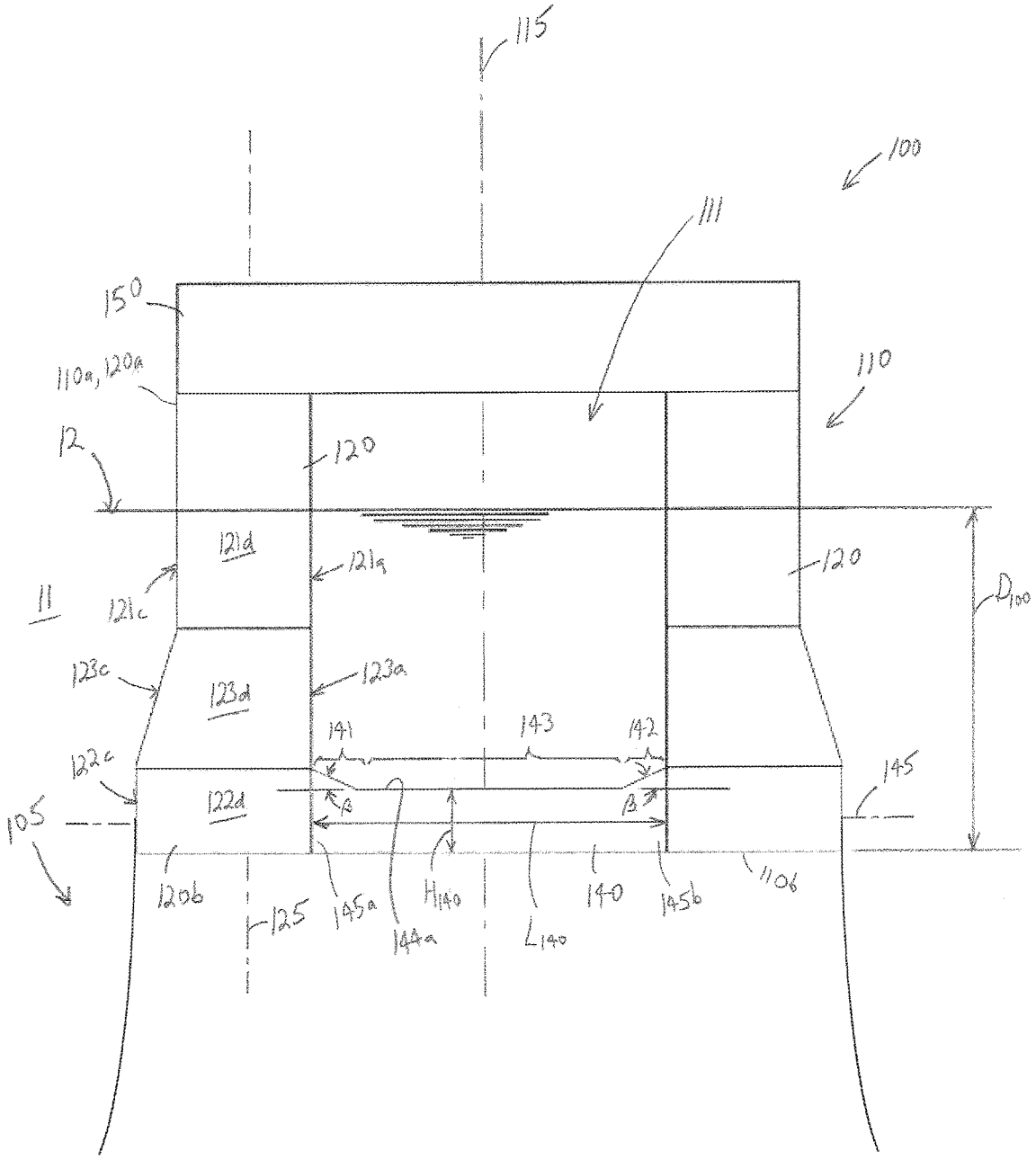
FIG. 4 is a schematic side view of the floating semi-submersible offshore platform of FIG. 3.

Referring now to FIGS. 3 and 4, an embodiment of a floating deep draft semi-submersible offshore structure or platform 100 in accordance with the principles described herein is shown. As best shown in FIG. 4, platform 100 is deployed in a body of water 11 in a deep draft operational configuration and anchored over an operation site with a mooring system 105. In this embodiment, mooring system 105 is a catenary mooring system, however, in general, any suitable mooring system (e.g., taut leg mooring system, catenary mooring system, etc.) can be employed to restrict the motion of platform 100.

In this embodiment, platform 100 includes a buoyant hull 110 and a deck or topsides 150 supported above the surface 12 of water 11 by hull 110. Hull 110 has a vertically oriented central axis 115, an upper end 110*a*, and a lower end 110*b*. As best shown in FIG. 4, platform 100 is deployed at a draft $D_{100}$ measured vertically from the surface 12 to the lower end 110*b* of hull 110. For a deep draft operational deployment, the draft $D_{100}$ is greater than 100 ft., and more preferably between 100 ft. and 200 ft.

Hull 110 includes a plurality of adjustably buoyant elongate columns 120 and a plurality of adjustably buoyant elongate pontoons 140 extending between columns 120. Columns 120 extend vertically between ends 110*a*, 110*b* and are uniformly circumferentially-spaced about axis 115. Pontoons 140 are disposed at lower end 110*b* and extend horizontally between each pair of circumferentially adjacent columns 120. In particular, two pontoons 140 extend laterally from each column 120 to the pair of circumferentially adjacent columns 120. As a result, pontoons 140 form a closed loop around axis 115 at the lower end 110*b* of hull 110. A central cavity or opening 111 within hull 110 extends from lower end 110*b* between pontoons 140 to deck 150 and allows risers to pass up through hull 110 to topsides 150.

In this embodiment, hull 110 includes four columns 120 and four pontoons 140, however, in general, embodiments described herein can include a different number of columns (e.g., columns 120) and pontoons (e.g., pontoons 140) such as three vertical columns and three horizontal pontoons extending between the columns.

Deck 150 is mounted to hull 110 atop columns 120 when platform 100 is operationally deployed and supports equipment typically used in oil and gas drilling and/or production operations. In general, deck 150 can be either a sealed, buoyant box structure or an open truss structure.

Referring still to FIGS. 3 and 4, each column 120 of the hull 110 extends linearly along a vertically oriented longitudinal axis 125 between a first or upper end 120*a* disposed at upper end 110*a* of hull 110 and a second or lower end 120*b* disposed at lower end 110*b* of hull 110. Deck 150 is attached to upper end 120*a* of each column 120, and pontoons 140 are fixably attached to lower ends 120*b* of columns 120. Each column 120 is an elongate tubular including a plurality of vertically stacked compartments, defined by bulkheads, that may be filled with solid ballast, ballast water, air or combinations thereof to adjustably control the buoyancy of each column 120, and hence, adjustably control the buoyancy of hull 110. In this embodiment, each column 120 is the same, and thus, one column 120 will be described it being understood that the remaining columns 120 are the same.

Figure 2:
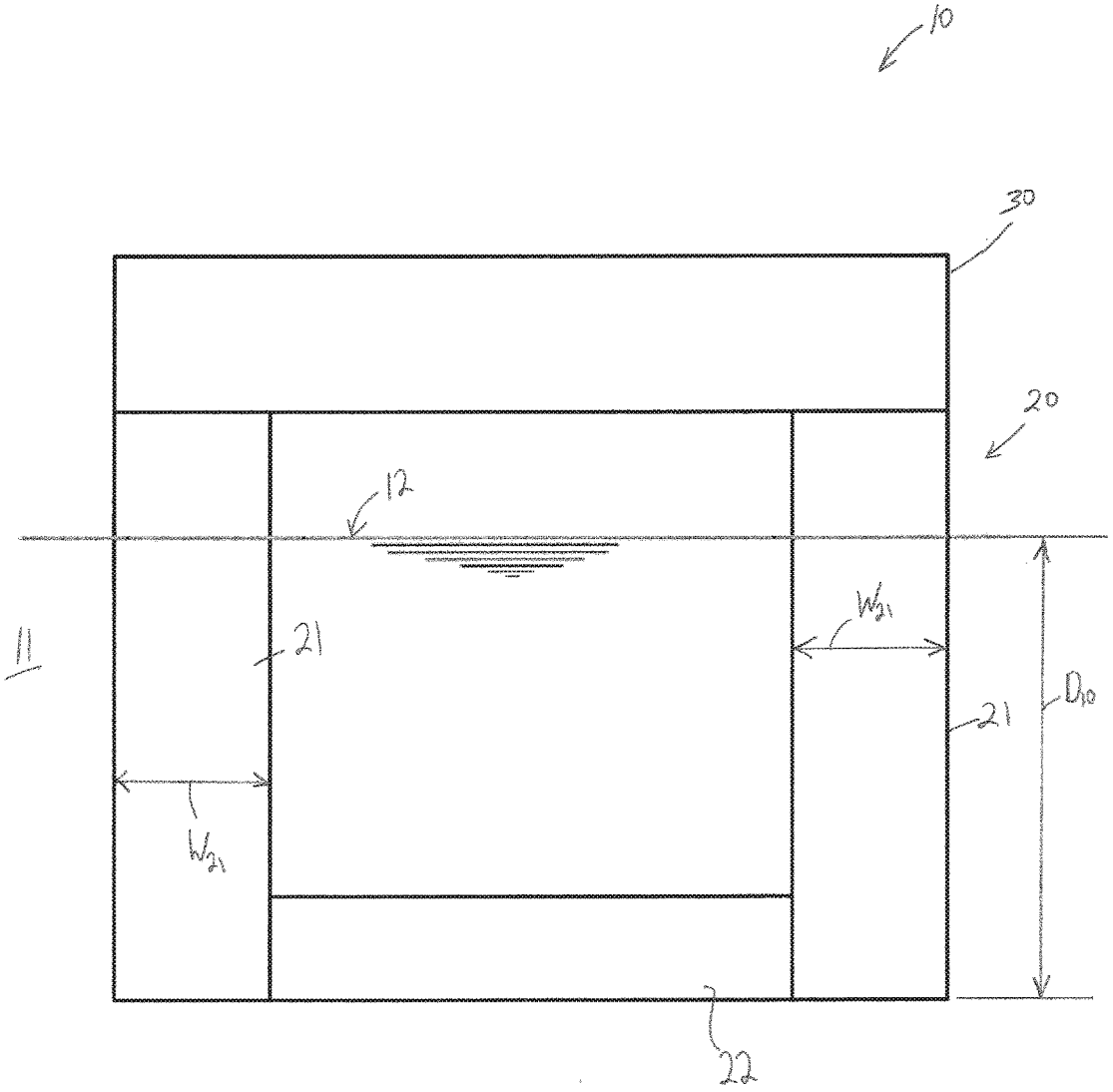
Figure 2 (Prior Art)
FIG. 2 is a schematic side view of the conventional floating semi-submersible offshore platform of FIG. 1.
Figure 5:
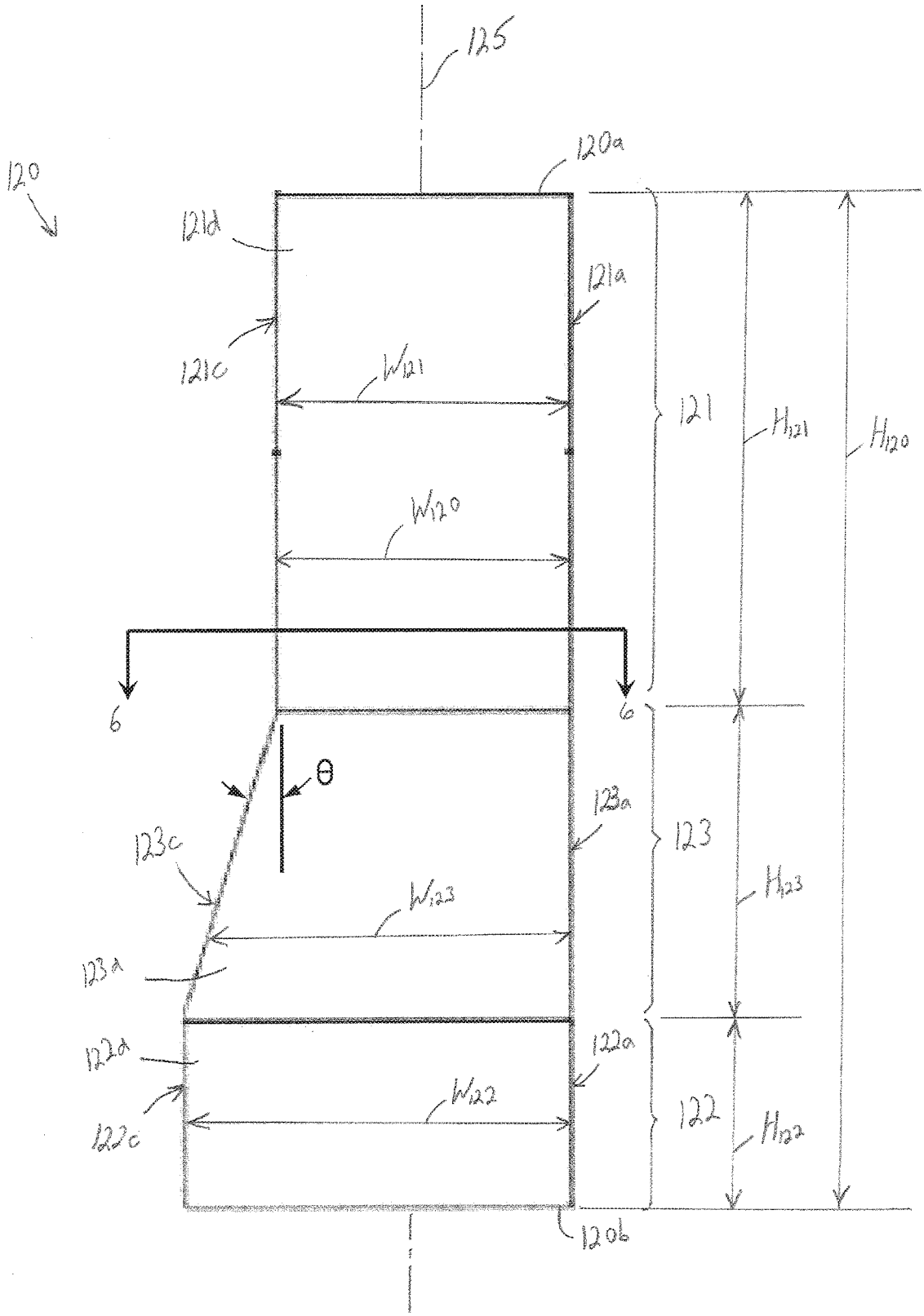
FIG. 5 is a schematic side view of one the columns of the floating semi-submersible offshore platform of FIG. 3.

Referring now to FIG. 5, unlike the columns of conventional semi-submersible platform (e.g., columns 21 of conventional semi-submersible platform 10 shown in FIGS. 1 and 2), which have constant or uniform widths between their upper and lower ends, in this embodiment, column 120 has a width $W_{120}$ measured perpendicular to axis 125 in side view (i.e., measured horizontally) that generally increases moving downward from upper end 120*a* to lower end 120*b*. More specifically, column 120 has a first or upper section 121 extending axially from upper end 120*a*, a second or lower section 122 extending axially from lower end 120*b*, and an intermediate section 123 extending axially between sections 121, 122. The width $W_{120}$ of column 120 at upper end 120*a* and along the entire upper section 121, also referred to as width $W_{121}$, is constant or uniform moving axially from end 120*a* to intermediate section 123; and the width $W_{120}$ of column 120 at lower end 120*b* and along the entire lower section 122, also referred to as width $W_{122}$, is constant or uniform moving axially from end 120*b* to intermediate section 123. However, the width $W_{121}$ of upper section 121 is less than the width $W_{122}$ of lower section 122. Intermediate section 123 provide a transition between sections 121, 122 having different widths $W_{121}$, $W_{122}$, respectively—the width $W_{120}$ along intermediate section 123, also referred to as width $W_{123}$, increases moving axially from upper section 121 to lower section 122. Thus, the width $W_{123}$ of intermediate section 123 is equal to width $W_{121}$ where sections 121, 123 intersect, and the width $W_{123}$ of intermediate section 123 is equal to width $W_{122}$ where sections 122, 123 intersect. In this embodiment, the width $W_{123}$ of intermediate section 123 changes linearly (at a constant rate) moving axially between sections 121, 122. Accordingly, intermediate section 123 may also be described herein as "tapered."

In embodiments described herein, the width $W_{122}$ of lower section 122 is preferably at least 5% greater than the width $W_{121}$ of upper section 121, more preferably 15% to 75% greater than the width $W_{121}$ of upper section 121, and even more preferably 25% to 50% greater than the width $W_{121}$ of upper section 121. In this embodiment, the width $W_{122}$ of lower section 122 is 31.6% greater than the width $W_{121}$ of upper section 121.

Referring still to FIG. 5, column 120 has a height $H_{120}$ measured axially from upper end 120*a* to lower end 120*b*. To enable deep draft operation deployment, height $H_{120}$ is preferably greater than 100 ft., more preferably between 100 ft. and 300 ft., and even more preferably between 120 ft. and 300 ft. In addition, upper section 121 of column 120 has a height $H_{121}$ measured axially from upper end 120*a* to intermediate section 123, lower section 122 of column 120 has a height $H_{122}$ measured axially from lower end 120*b* to intermediate section 123, and tapered section 123 of column 120 has a height $H_{123}$ measured axially between sections 121, 122. In embodiments described herein, and with respect to the draft $D_{100}$ of platform 100, the height $H_{123}$ of tapered section 123 is preferably at least 5% of the draft $D_{100}$, more preferably at least 15% of the draft $D_{100}$, and even more preferably 30% to 50% of the draft $D_{100}$. In embodiments described herein, and with respect to the total column height $H_{120}$, the height $H_{123}$ of tapered section 123 is preferably at least 2% of the height $H_{120}$, more preferably at least 10% of the height $H_{120}$, and even more preferably 15% to 50% of the height $H_{120}$. In this embodiment, the height $H_{123}$ of tapered section 123 is about 31% of the height $H_{120}$.

Although each column 140 includes three distinct sections 121, 122, 123 in this embodiment, in other embodiments, lower sections 123 are eliminated from columns 120 and the tapered sections 122 extend axially to the lower ends 120*b* of column 120. In such embodiments, pontoons 140 are disposed at the lower end 110*b* of hull 110, but extend between the tapered sections 122. As will be described in more detail below, the deep draft $D_{100}$ of hull 100 in combination with the geometry and dimensions of sections 121, 122, 123 of columns 120 offers the potential to reduce the heave and VIM motions, and to increase buoyancy and stability of platform 100.

Figure 6:
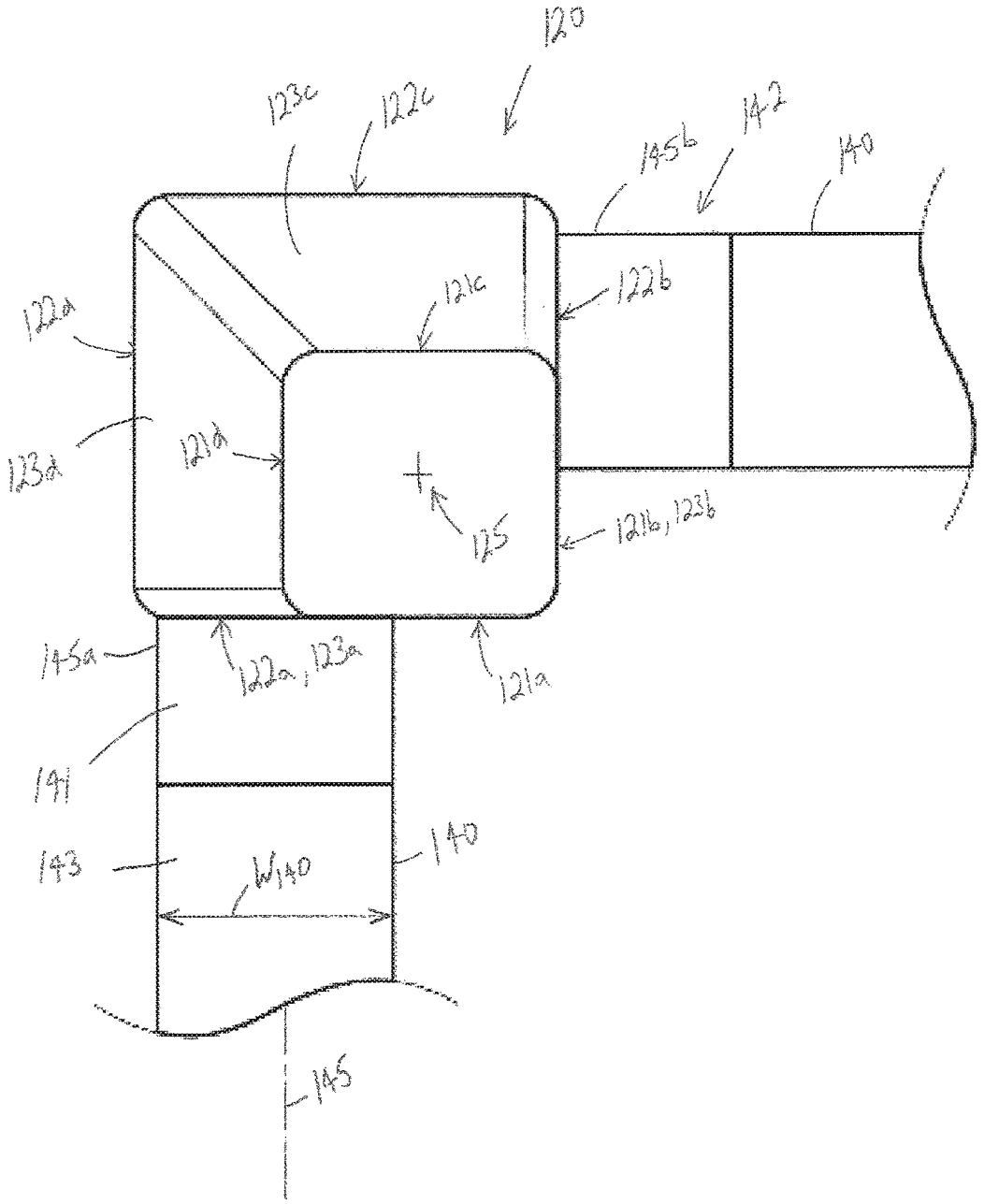
FIG. 6 is an enlarged partial cross-sectional top view of the column of FIG. 5 taken along section 6-6 of FIG. 5.

Referring now to FIGS. 3, 5, and 6, in this embodiment, column 120 has a rectangular, and more specifically a square, cross-sectional shape in any and all planes oriented perpendicular to axis 125 between ends 120*a*, 120*b*. In particular, each section 121, 122, 123 includes four outer planar surfaces or sides that intersect at corners that can be rounded or radiused. In particular, upper section 121 includes four planar outer surfaces or sides 121*a*, 121*b*, 121*c*, 122*d* disposed about axis 125, lower section 122 includes four planar outer surfaces or sides 122*a*, 122*b*, 122*c*, 122*d* disposed about axis 125, and intermediate section 123 includes four planar outer surfaces or sides 123*a*, 123*b*, 123*c*, 123*d* disposed about axis 125. Sides 121*a*, 121*b*, 121*c*, 121*d* of upper section 121 are vertically oriented, parallel to axis 125, and arranged 90° apart; and sides 122*a*, 122*b*, 122*c*, 122*d* of lower section 122 are vertically oriented, parallel to axis 125, and arranged 90° apart. In addition, sides 123*a*, 123*b* of intermediate section 123 are vertically oriented, parallel to axis 125, and arranged 90° apart. However, in this embodiment, sides 123*c*, 123*d* of intermediate section are not vertically oriented and are not parallel to axis 125. Rather, as best shown in FIG. 5, each side 123*c*, 123*d* is oriented at an acute angle θ relative to axis 125 in side view (i.e., measured upward from axis 125 to side 123*c*, 123*d*, respectively, in side view). Since sides 123*c*, 123*d* are oriented acute slope angle θ relative to axis 125 in side view, and hence are not vertically oriented, sides 123*c*, 123*d* may also be described herein as "sloped." In embodiments described herein, the slope angle θ of a sloped side of a column (e.g., side 123*c*, 123*d* of column 120) is preferably between 3° and 60°, more preferably between 5° and 60°, and even more preferably between 10° and 30°. In this embodiment, the slope angle θ of each side 123*c*, 123*d* is 16.5°.

Figure 7:
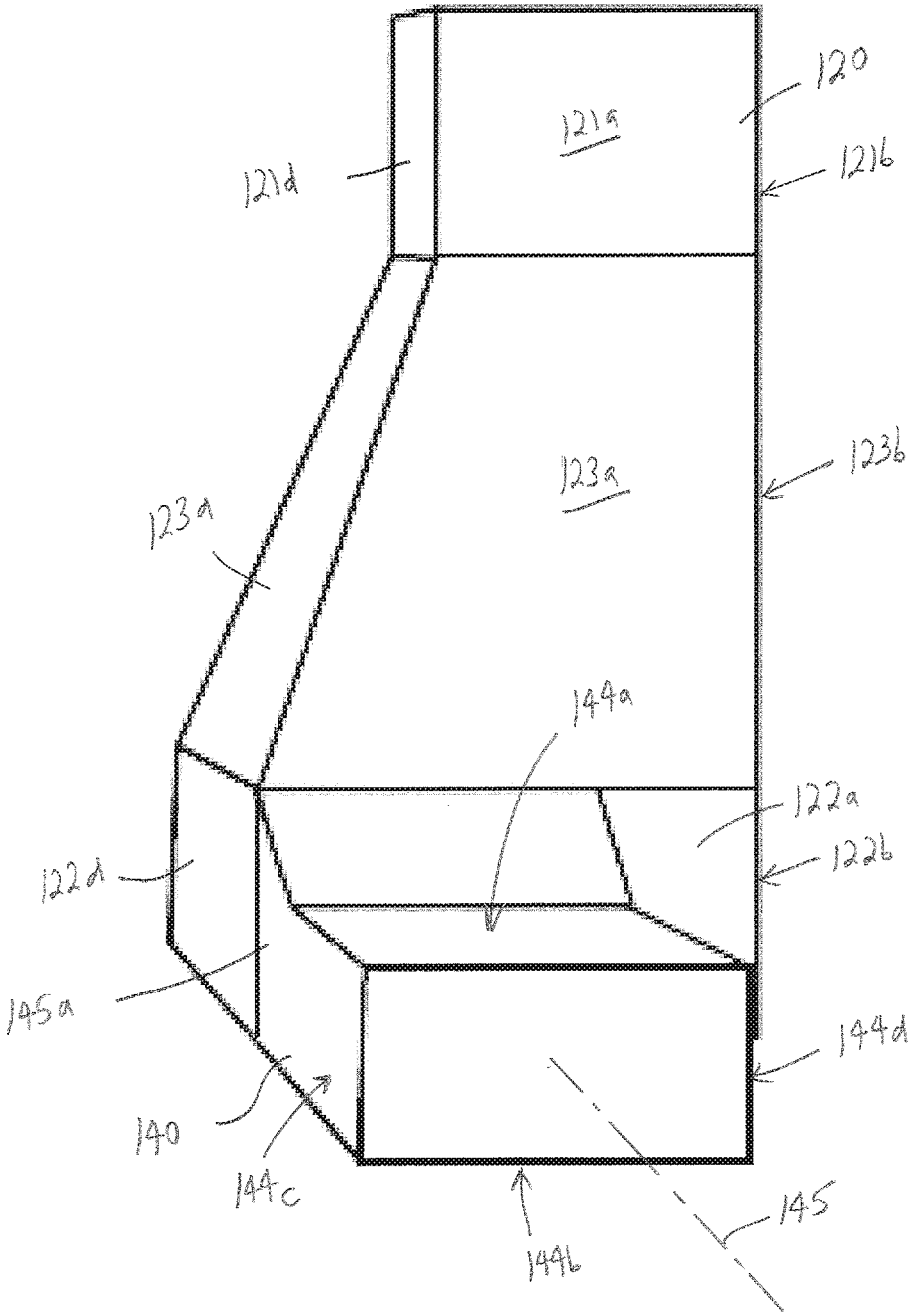
FIG. 7 is an enlarged partial cross-sectional perspective view of one pontoon of the floating semi-submersible offshore platform of FIG. 3.

Referring now to FIGS. 5-7, in this embodiment, sides 121*a*, 122*a*, 123*a* are vertically aligned, flush, and disposed in a common vertical plane, thereby forming a smooth, contiguous, planar, vertical side of column 120 extending between ends 120*a*, 120*b*; and likewise, sides 121*b*, 122*b*, 123*b* are vertically aligned, flush, and disposed in a common vertical plane, thereby forming a smooth, contiguous, planar, vertical side of column 120 extending between ends 120*a*, 120*b*. Sides 121*c*, 122*c*, 123*c* are coupled end-to-end and arranged one-above-the-other, however, due to the slope of side 123*c*, are not disposed in a common vertical plane; and likewise, sides 121*d*, 122*d*, 123*d* are coupled end-to-end and arranged one-above-the-other, however, due to the slope of side 123*d*, are not disposed in a common vertical plane.

As best shown in FIGS. 3 and 6, in this embodiment, sides 121*c*, 121*d*, 122*c*, 122*d*, 123*c*, 123*d* are disposed along the outside of hull 110 (relative to axis 115), generally lie along the outer perimeter of hull 110, and generally face away from the remainder of hull 110. In contrast, sides 121*a*, 121*b*, 122*a*, 122*b*, 123*a*, 123*b* are disposed along the inside of hull 110 (relative to axis 115), do not lie along the outer perimeter of hull 110, and generally face toward other structures of hull 110. For example, sides 121*a*, 121*b*, 122*a*, 122*b*, 123*a*, 123*b* face towards circumferentially adjacent columns 120. Accordingly, sides 121*c*, 121*d*, 122*c*, 122*d*, 123*c*, 123*d* may also be described herein as "exterior" sides of hull 110 and corresponding sections 121, 122, 123; and sides 121*a*, 121*b*, 122*a*, 122*b*, 123*a*, 123*b* may also be described herein as "interior" sides of hull 110 and corresponding sections 121, 122, 123. Thus, sides 123*c*, 123*d* of tapered section 123 are exterior sides of tapered section 123, and sides 123*a*, 123*b* of tapered section 123 are interior sides of tapered section 123. In embodiments described herein, each exterior sides of the tapered section of each column (e.g., sides 123*c*, 123*d* of section 123 of each column 120) are preferably sloped sides oriented at a slope angle θ. The interior sides of the tapered section of each column (e.g., sides 123*a*, 123*b* of section 123 of each column 120) can be sloped sides oriented at a slope angle θ or vertically oriented parallel to the central axis of the corresponding column (e.g., parallel to axis 125 of the corresponding column 120).

Referring again to FIGS. 5 and 6, for purposes of comparing widths $W_{121}$, $W_{122}$, $W_{123}$, each width $W_{121}$, $W_{122}$, $W_{123}$ is preferably measured in the same manner. As previously described, in this embodiment, width $W_{120}$ of column 120 and widths $W_{121}$, $W_{122}$, $W_{123}$ of sections 121, 122, 123 are measured perpendicular to axis 125 in side view. More specifically, width $W_{120}$ of column 120 and widths $W_{121}$, $W_{122}$, $W_{123}$ of sections 121, 122, 123 are measured perpendicular to axis 125 in side view between opposed exterior and interior sides of column 120 and each corresponding section 121, 122, 123 in side view (i.e., between interior and exterior sides that are spaced 180° apart about axis 125). For instance, in FIG. 5, the width $W_{121}$ is measured perpendicular to axis 125 in side view between exterior side 121*d* and interior side 121*b*, the width $W_{122}$ is measured perpendicular to axis 125 in side view between exterior side 122*d* and interior side 122*b*, and the width $W_{123}$ is measured perpendicular to axis 125 in side view between exterior side 123*d* and interior side 123*b*. This approach to measuring and comparing widths of columns or sections thereof can generally be used when there are an equal number of sides. However, this approach may difficult to apply to columns having an odd number of sides (e.g., a column having five sides angularly spaced 72° apart) or columns lacking sides that are spaced 180° apart (e.g., a generally cylindrical column). Accordingly, as an alternative to measuring the width of a column or sections thereof perpendicular to the central axis between opposed interior and exterior sides in side view, the width of the column or section thereof can also be determined by the maximum width measured perpendicular to the central axis in side view or, in the case of a generally cylindrical column, the diameter of the column measured perpendicular to the central axis in side view.

As previously described, in this embodiment, each column 120 has square cross-sectional shape. However, as will be described in more detail below, in other embodiments, the cross section of each column in a plane perpendicular to the central axis of the column can have other cross-sectional shapes including, without limitation, polygonal shapes (e.g., hexagonal, octagonal, etc.), circular shapes, etc.

Referring now to FIGS. 3, 4, and 7, each pontoon 140 extends horizontally between two columns 120. In particular, each pontoon 140 has a horizontally oriented longitudinal axis 145, a first end 140*a* coupled to lower section 122 of one column 120, and a second end 140*b* coupled to the lower section 122 of a circumferentially adjacent column 120. In this embodiment, each end 140*a* is attached to the interior side 122*a* of one column 120 and each end 140*b* is attached to the interior side 122*b* of one column 120. Each pontoon 140 includes ballast tanks that can be selectively filled with ballast water to adjust the buoyancy of the pontoon 140, and hence, hull 110.

Referring now to FIGS. 4 and 6, in this embodiment, each pontoon 140 is the same, and thus, one pontoon 140 will be described it being understood that the remaining pontoons 140 are the same. Pontoon 140 has a rectangular cross-section taken at any and all planes oriented perpendicular to axis 145 between ends 140*a*, 140*b*. In addition, pontoon 140 has a length $L_{140}$ measured parallel to axis 145 between ends 140*a*, 140*b*, a width $W_{140}$ measured perpendicular to axis 145 in top view (i.e., measured horizontally), and a height $H_{140}$ measured perpendicular to axis 145 in side view (i.e., measured vertically). In this embodiment, the width $W_{140}$ of pontoon 140 is uniform or constant moving axially between ends 140*a*, 140*b*, however, the height $H_{140}$ of pontoon 140 varies moving axially between ends 140*a*, 140*b*. In particular, pontoon 140 has a first section 141 extending axially from end 140*a*, a second section 142 extending axially from end 140*b*, and an intermediate section 143 extending axially between sections 141, 142. The height $H_{140}$ of pontoon 140 is uniform or constant moving axially along intermediate section 140 between sections 141, 142, however, the height $H_{140}$ of pontoon 140 decreases moving axially along section 141 from end 140*a* to section 143, and the height $H_{140}$ of pontoon 140 decreases moving axially along section 142 from end 140*b* to section 143. Thus, the height $H_{140}$ at ends 140*a*, 140*b* represents the maximum height $H_{140}$ of pontoon 140, and the height $H_{140}$ along intermediate section 143 represents the minimum height $H_{140}$ of pontoon 140. In this embodiment, the height $H_{140}$ of each section 141, 142 changes linearly (at a constant rate) moving axially from intermediate section 143 to end 140*a*, 140*b*, respectively. Accordingly, sections section 141, 142 may also be described herein as "tapered."

In this embodiment, pontoon 140 has a rectangular cross-section in each plane oriented perpendicular to axis 145. In particular, as best shown in FIGS. 3 and 7, pontoon 140 has a top or upper side 144*a* extending between ends 140*a*, 140*b*, a bottom or lower side 144*b* extending between ends 140*a*, 140*b*, and a pair of lateral sides 144*c*, 144*d* extending between ends 140*a*, 140*b*. Lower side 144*b* is planar and extends horizontally between ends 140*a*, 140*b*. Lateral sides 144*c*, 144*d* are planar and extend vertically between upper side 144*a* and lower side 144*b*. Upper side 144*a* extends horizontally along intermediate section 143, but, as shown in FIG. 4, is oriented at an acute angle β relative to axis 145 in side view (i.e., measured upward from axis 145 to side 144*a* in side view) along sections 141, 142. Since side 144*a* is oriented acute slope angle β relative to axis 145 in side view along sections 141, 142, and hence is not horizontally oriented along sections 141, 142, the portion of upper side 144*a* extending along sections 141, 142 may also be described herein as "sloped."

The width $W_{140}$ of pontoon 140 is measured perpendicular to axis 145 between lateral sides 144*c*, 144*d* in top view. In this embodiment, sides 144*c*, 144*d* are vertically oriented and parallel between ends 140*a*, 140*b*. Thus, the width $W_{140}$ of pontoon 140 is constant moving axially between ends 140*a*, 140*b* as previously described. The height $H_{140}$ of pontoon 140 is measured perpendicular to axis 145 between sides 144*a*, 144*b* in side view. In this embodiment, lower side 144*b* is horizontally oriented between ends 140*a*, 140*b*, and upper side 144*a* is horizontally oriented long intermediate section 143 (i.e., between sections 141, 142). However, upper side 144*a* slopes upward at angle β moving axially along each section 141, 142 from intermediate section 143 to end 140*a*, 140*b*, respectively. Thus, the height $H_{140}$ of pontoon 140 is constant moving axially along intermediate section 143, but increases linearly moving along sections 141, 142 from intermediate section 143 to ends 140*a*, 140*b*, respectively, as previously described.

In general, the geometry of tapered sections 141, 142 will depend on a variety of factors including, without limitation, the structural and functional requirements, and the construction and deployment processes. Although lower side 144*b* is planar and horizontally oriented along its entire length and upper side 144*a* is oriented at slope angle β in sections 141, 142 in this embodiment, in other embodiments, the lower side of the pontoon (e.g., lower side 144*b*) can be sloped along the tapered sections (e.g., sections 141, 142), both the upper and lower sides of the pontoon (e.g., sides 144*a*, 144*b*) can be sloped along the tapered sections, or both the upper and lower sides can be horizontally oriented along their entire lengths such that the height of the pontoon (e.g., height $H_{140}$) is constant along its entire length and lacks tapered sections.

Referring still to FIGS. 3, 4, and 7, in this embodiment, the length $L_{140}$ of each pontoon 140 is the same, and thus, hull 110 has a generally square shape and perimeter in top view. However, in other embodiments, the length of one or more of the pontoons (e.g., lengths $L_{140}$ of pontoons 140) may be different. In addition, although pontoons 140 have square cross-sectional shapes in this embodiment, in other embodiments, the pontoons can have other cross-sectional shapes including, without limitation, polygonal shapes, circular shapes, etc.

Figure 8:
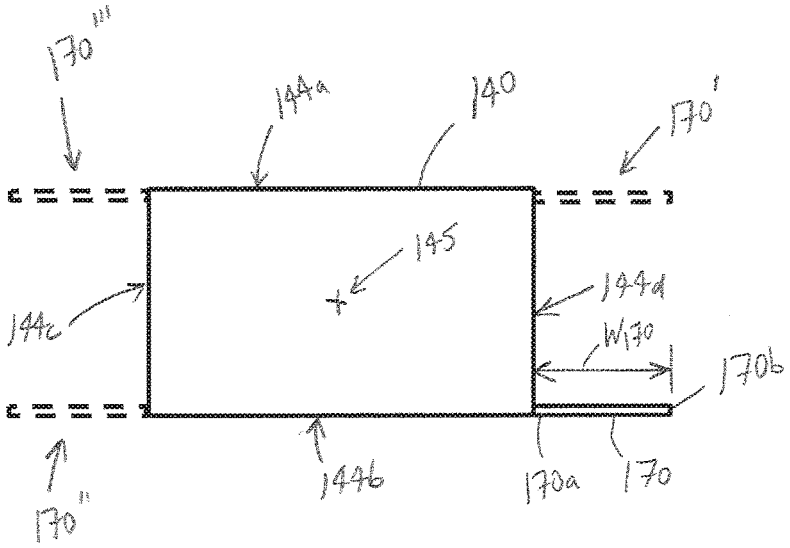
FIG. 8 is a schematic cross-sectional view of an embodiment of a pontoon for use with the floating semi-submersible offshore platform of FIG. 3 and having a horizontal skirt plate.
Figure 9:
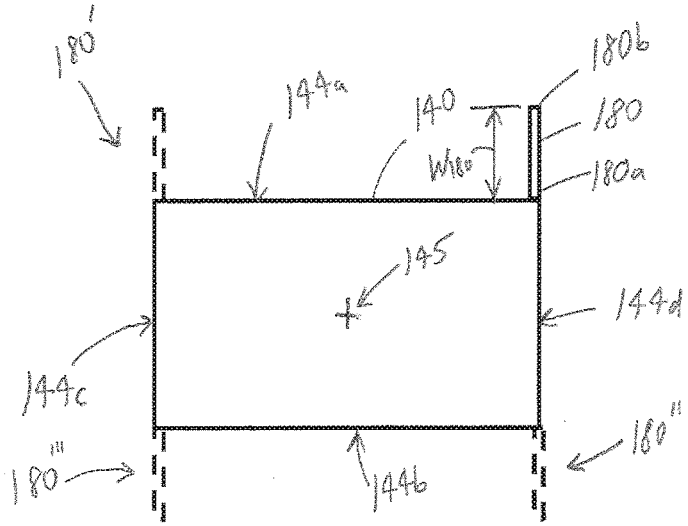
FIG. 9 is a schematic cross-sectional view of an embodiment of a pontoon for use with the floating semi-submersible offshore platform of FIG. 3 and having a vertical skirt plate.

Referring now to FIGS. 8 and 9, in embodiments described herein, each pontoon 140 can include one or more horizontal skirt plates 170 as shown in FIG. 8 and/or one or more vertical skirt plates 180 as shown in FIG. 9. In general, a horizontal skirt plate 170 is a flat plate that extends horizontally from the pontoon 140, whereas a vertical skirt plate 180 is a flat plate that extends vertically from the pontoon 140. In particular, each skirt plate 170, 180 has a fixed end 170*a*, 180*a*, respectively, attached to pontoon 140 and a free end 170*b*, 180*b*, respectively, distal pontoon 140. Each skirt plate 170, 180 preferably extends horizontally from end 140*a* to end 140*b* of the pontoon 140.

Horizontal skirt plate 170 has a width $W_{170}$ measured horizontally from end 170*a* mounted to pontoon 140 and end 170*b* distal pontoon 140, and vertical skirt plate 180 has a height $H_{180}$ measured vertically from end 180*a* mounted to pontoon 140 and end 180*b* distal pontoon 140. The width $W_{170}$ of skirt plate 170 is preferably less than 200% the width $W_{140}$ of pontoon 140, and more preferably between 20% and 50% the width $W_{140}$ of pontoon 140. The height $H_{180}$ of skirt plate 180 is preferably less than 100% the minimum height $H_{140}$ of pontoon 140 (i.e., the height $H_{140}$ along intermediate section 143), and more preferably between 20% and 50% of the minimum height $H_{140}$ of pontoon 140.

In general, a horizontal skirt plate 170 can be positioned at the top or bottom of the pontoon 140 and extend radially inward (relative to axis 115) from interior side 144*d* into opening 111 or extend radially outward (relative to axis 115) from exterior side 144*c*. When the horizontal skirt plate 170 is position at the top of the pontoon 140, it is preferably flush with upper surface 144*a*, and when the horizontal skirt plate 170 is positioned at the bottom of the pontoon 140, it is preferably flush with lower surface 144*b*. As shown in FIG. 8, in this embodiment, one horizontal skirt plate 170 is attached to the bottom of interior side 144*d* and extends radially into opening 111. However, in other embodiments, the horizontal skirt plate 170 can be attached to the top of interior side 144*d* and extend radially into opening 111 as shown in phantom and designated with reference numeral 170', the horizontal skirt plate 170 can be attached to the bottom of exterior side 144*c* and extend radially outward therefrom as shown in phantom and designated with reference numeral 170", or the horizontal skirt plate 170 can be attached to the top of exterior side 144*c* and extend radially outward therefrom as shown in phantom and designated with reference numeral 170'''. For ease of construction and to avoid an increase in the footprint of hull 110, the horizontal skirt plate 170 is preferably attached to the bottom of interior side 144*d* and extends radially into opening 111 as shown in FIG. 8.

In general, a vertical skirt plate 180 can be positioned at the inside or outside of the pontoon 140 (relative to axis 115) and extend vertically upward from upper side 144*a* or extend vertically downward from lower side 144*b*. When the vertical skirt plate 180 is position at the inside of the pontoon 140, it is preferably flush with interior side 144*d*, and when the vertical skirt plate 180 is positioned at the outside of the pontoon 140, it is preferably flush with exterior side 144*c*. As shown in FIG. 9, in this embodiment, one vertical skirt plate 180 is attached to the inside of upper side 144*a* and extends vertically upward therefrom. However, in other embodiments, the vertical skirt plate 180 can be attached to the outside of upper side 144*a* and extend vertically upward as shown in phantom and designated with reference numeral 180', the vertical skirt plate 180 can be attached to the inside of lower side 144*b* and extend vertically downward therefrom as shown in phantom and designated with reference numeral 180", or the vertical skirt plate 180 can be attached to the outside of bottom surface 144*b* and extend vertically downward therefrom as shown in phantom and designated with reference numeral 180'''. For ease of construction, the vertical skirt plate 170 is preferably attached to the inside of upper side 144*a* and extends vertically upward therefrom as shown in FIG. 9.

In general, horizontal skirt plates 170 dampen and reduce the vertical heave motions of platform 100. In addition, horizontal skirt plates 170 increase the heave added mass of hull 110 and move the heave natural periods further away from wave energy spectra. In general, the vertical skirt plates 180 dampen and reduce the lateral motions of platform 100 and rotational motions of platform 100 about axis 115 induced by wind, wave actions and vortex induced motion (VIM).

Figure 10:
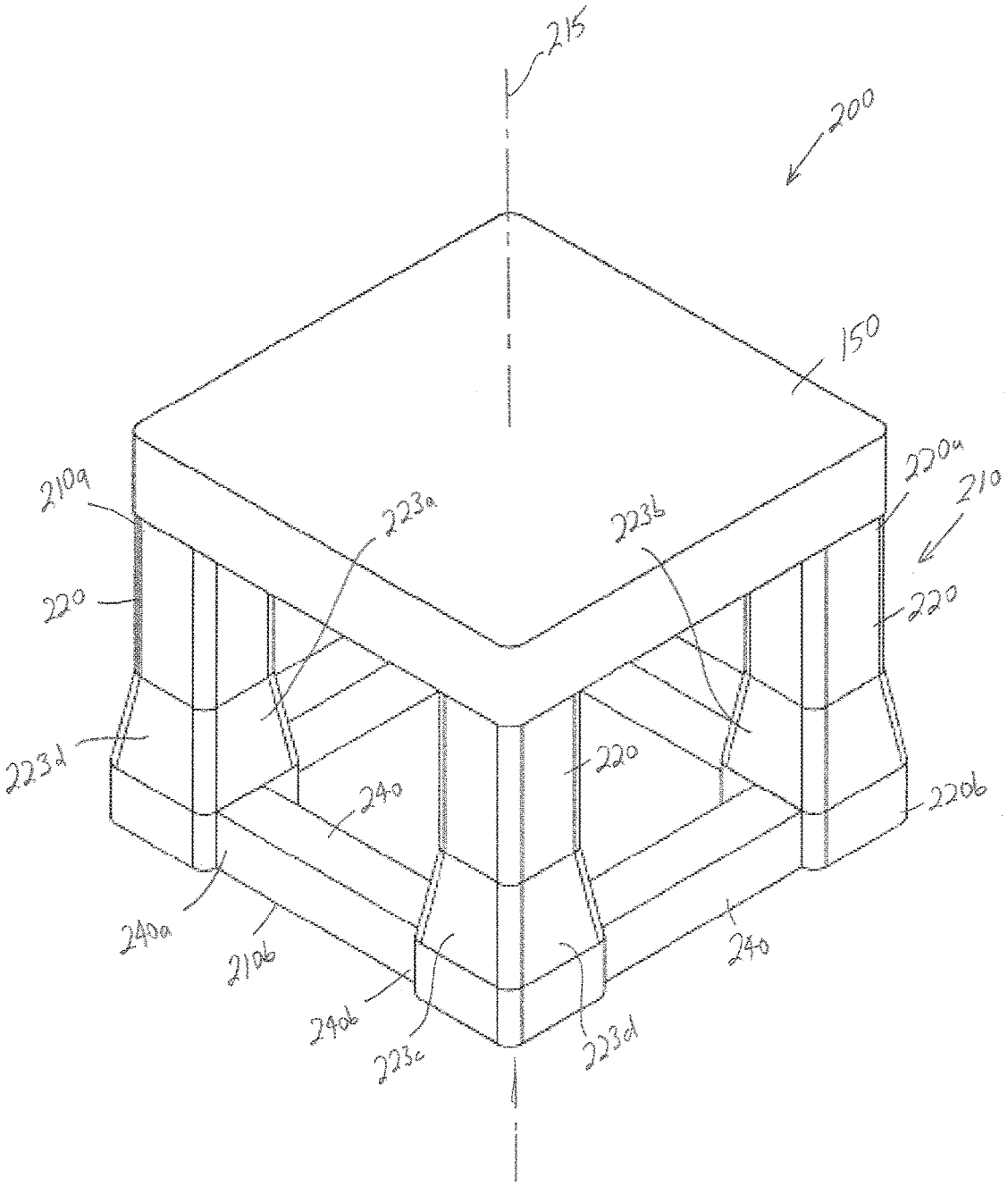
FIG. 10 is a perspective view of an embodiment of a floating semi-submersible offshore platform in accordance with the principles described herein.
Figure 11:
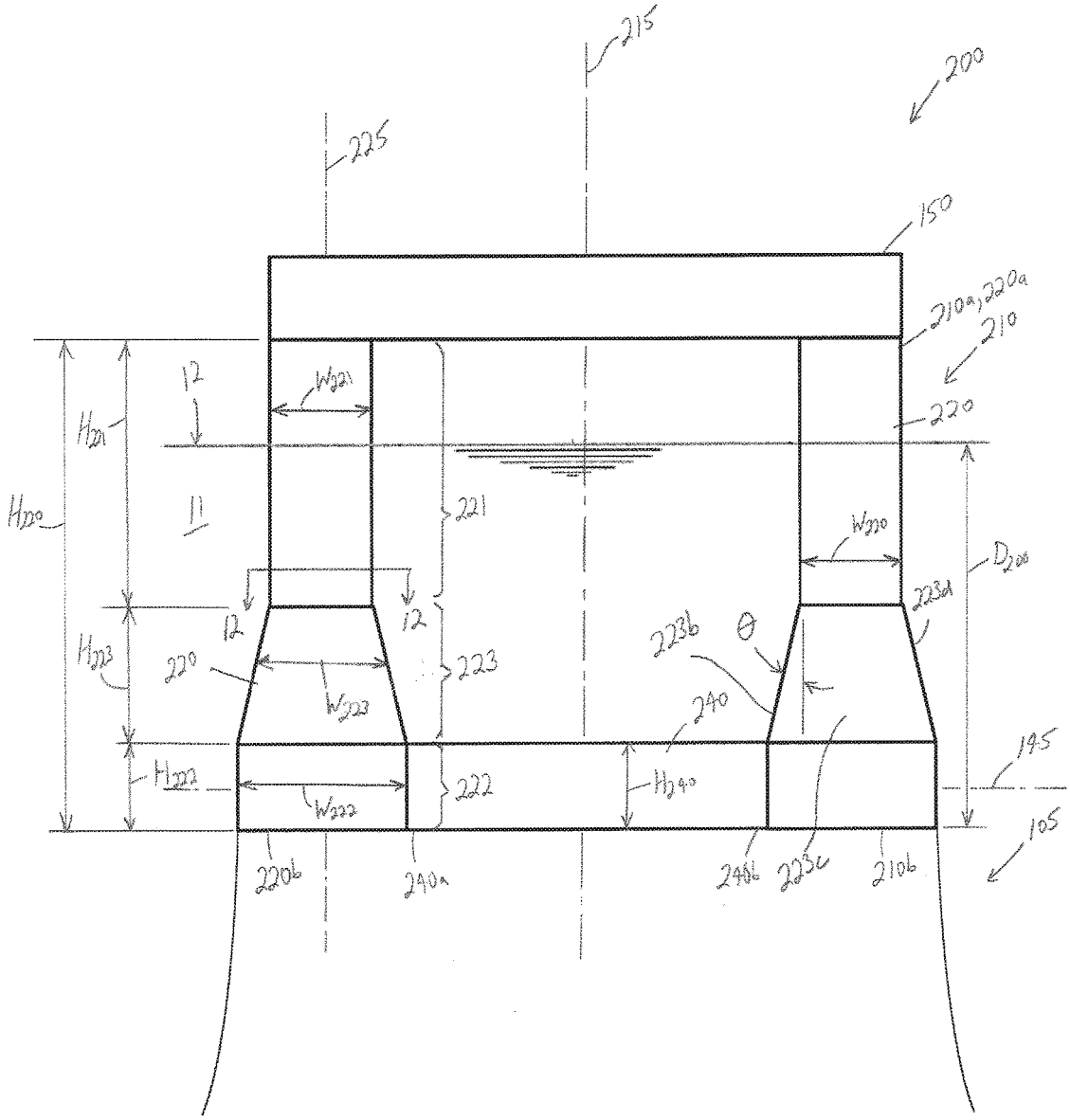
FIG. 11 is a schematic side view of the floating semi-submersible offshore platform of FIG. 10.

Referring now to FIGS. 10 and 11, another embodiment of a floating deep draft semi-submersible offshore structure or platform 200 in accordance with the principles described herein is shown. Platform 200 is deployed in a body of water 11 in a deep draft operational configuration and anchored over an operation site with a mooring system 105 as previously described.

Platform 200 includes a buoyant hull 210 and a deck or topsides 150 as previously described supported above the surface 12 of water 11 by hull 210. Hull 210 has a vertically oriented central axis 215, an upper end 210*a*, and a lower end 210*b*. In addition, platform 200 is deployed at a draft $D_{200}$ measured vertically from the surface 12 to the lower end 210*b* of hull 210. For a deep draft operational deployment, the draft $D_{200}$ is greater than 100 ft., and more preferably between 100 ft. and 200 ft.

Hull 210 includes a plurality of adjustably buoyant elongate columns 220 and a plurality of adjustably buoyant elongate pontoons 240 extending between columns 220. Columns 220 extend vertically between ends 210*a*, 210*b* and are uniformly circumferentially-spaced about axis 215. Pontoons 240 are disposed at lower end 210*b* and extend horizontally between each pair of circumferentially adjacent columns 220. Each column 220 is the same, and each pontoon 240 is the same.

Columns 220 are substantially the same as columns 120 previously described. Namely, each column 220 has a square cross-sectional shape and extends linearly along a vertically oriented longitudinal axis 225 between a first or upper end 220*a* disposed at upper end 210*a* of hull 210 and a second or lower end 220*b* disposed at lower end 210*b* of hull 210. Deck 150 is attached to upper end 220*a* of each column 220, and pontoons 240 are fixably attached to lower ends 220*b* of columns 220. In addition, each column 220 has a width $W_{220}$ measured perpendicular to axis 225 in side view (i.e., measured horizontally) that generally increases moving downward from upper end 220*a* to lower end 220*b*. More specifically, column 220 has a first or upper section 221 extending axially from upper end 220*a*, a second or lower section 222 extending axially from lower end 220*b*, and a tapered, intermediate section 223 extending axially between sections 221, 222. Upper section 221 is the same as upper section 121 previously described, and lower section 222 is the same as lower section 122 as previously described. In addition, the width $W_{220}$ of column 220 increases moving axially downward along tapered section 223 from section 221 to section 222. The width $W_{220}$ along lower section 222, referred to as width $W_{222}$, is preferably at least 5% greater than the width $W_{221}$ of upper section 221, referred to as width $W_{221}$, the width $W_{222}$ is more preferably 15% to 75% greater than the width $W_{221}$, and the width $W_{222}$ is even more preferably 25% to 50% greater than the width $W_{221}$.

Unlike tapered section 123 previously described, which included two vertically oriented interior sides 123*a*, 123*b* and two sloped exterior sides 123*c*, 123*d* disposed at angles θ, in this embodiment, each side 223*a*, 223*b*, 223*c*, 223*d* of tapered section 223 is sloped and oriented at an acute slope angle θ relative to axis 225 in side view (i.e., measured upward from axis 225 to each side 223*a*, 223*b*, 223*c*, 223*d* in side view). In other words, both interior sides 223*a*, 223*b* and both exterior sides 223*c*, 223*d* of tapered section 223 are disposed at a slope angle θ. In this embodiment, the slope angle θ of a sloped side of a column (e.g., side 223*a*, 223*b*, 223*c*, 223*d* of column 220) is preferably between 3° and 60°, more preferably between 3° and 40°, and even more preferably between 5° and 20°. In this embodiment, the slope angle θ of each side 223*a*, 223*b*, 223*c*, 223*d* is 8.5°.

As best shown in FIG. 11, column 220 has a height $H_{220}$ measured axially from upper end 220*a* to lower end 220*b*. To enable deep draft operation deployment, height $H_{220}$ is preferably greater than 100 ft., more preferably between 100 ft. and 300 ft., and even more preferably between 120 ft. and 300 ft. In addition, upper section 221 of column 220 has a height $H_{221}$ measured axially from upper end 220*a* to intermediate section 223, lower section 222 of column 220 has a height $H_{222}$ measured axially from lower end 220*b* to intermediate section 223, and tapered section 223 of column 220 has a height $H_{223}$ measured axially between sections 221, 222. In embodiments described herein, and with respect to the draft $D_{200}$ of platform 200, the height $H_{223}$ of tapered section 223 is preferably at least 5% of the draft $D_{200}$, more preferably at least 15% of the draft $D_{200}$, and even more preferably 30% to 50% of the draft $D_{200}$. In embodiments described herein, and with respect to the total column height $H_{220}$, the height $H_{223}$ of tapered section 223 is preferably at least 2% of the height $H_{220}$, more preferably at least 10% of the height $H_{220}$, and even more preferably 15% to 50% of the height $H_{220}$. In this embodiment, the height $H_{223}$ of tapered section 223 is about 31% of the height $H_{220}$.

Figure 12:
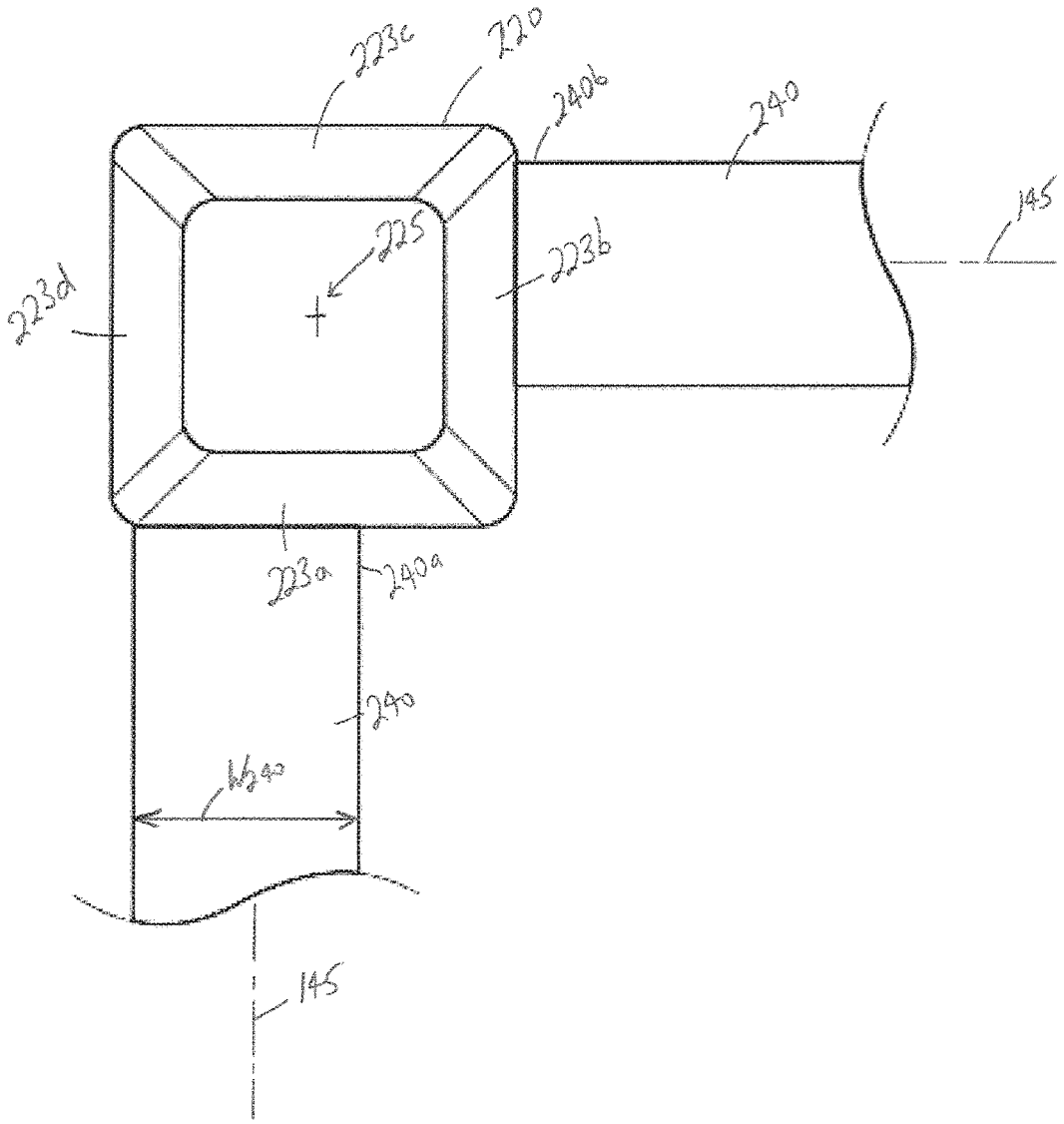
FIG. 12 is an enlarged partial cross-sectional top view of one column of the floating semi-submersible offshore platform of FIG. 11 taken along section 12-12 of FIG. 11.

Referring still to FIGS. 10-12, pontoons 240 are substantially the same as pontoons 140 previously described with the exception that pontoons 240 do not include any tapered sections. Thus, each pontoon 240 has a horizontally oriented longitudinal axis 245, a first end 240*a* coupled to lower section 222 of one column 220, and a second end 240*b* coupled to the lower section 222 of a circumferentially adjacent column 220. In addition, each pontoon 240 has a width $W_{240}$ measured perpendicular to axis 245 between the lateral sides of pontoon 240 in top view that is constant moving axially between ends 240*a*, 240*b*. However, since pontoons 240 do not include any tapered sections, each pontoon 240 has a height $H_{240}$ measured perpendicular to axis 245 between the upper and lower sides of pontoon 240 in side view that is constant moving axially between ends 240*a*, 240*b*. One or more horizontal skirt plates 170 and/or one or more vertical skirt plates 180 as previously described may be provided on pontoons 240.

Although each column 120 of platform 100 previously described and shown in FIGS. 3 and 4 has a vertically oriented longitudinal axis 125, since exterior sides 123*c*, 123*d* are sloped while interior sides 123*a*, 123*b* are vertically oriented and aligned flush with sides 121*a*, 121*b*, respectively, and sides 122*a*, 122*b*, respectively, upper section 121 is not coaxially aligned with lower section 122. Rather, the central axis of upper section 121 is parallel to but radially offset from the central axis of lower section 122. However, in embodiments where the tapered section (e.g., section 223) is symmetric, and each side of the tapered section is disposed at the same slope angle θ and has the same shape and geometry, the upper section (e.g., section 221), lower section (e.g., section 222), and the tapered section (e.g., section 223) of the column (e.g., column 220) are coaxially aligned. It should also be appreciated that by sloping all the sides of the tapered section, the horizontal distance or span between circumferentially adjacent columns can be increased while maintaining the same overall footprint and outer perimeter of the hull, which offers the potential to enhance stability of the platform.

Figure 13:
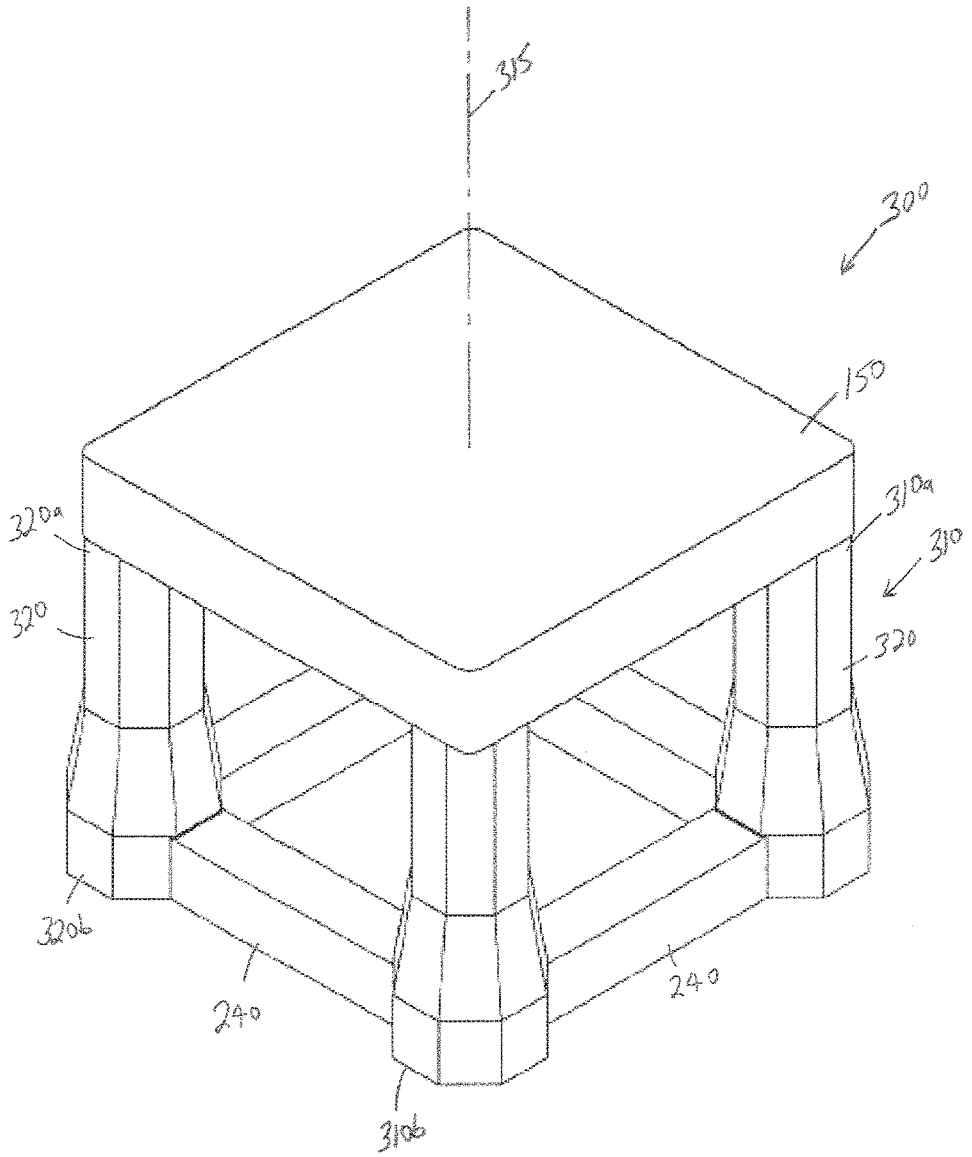
FIG. 13 is a perspective view of an embodiment of a floating semi-submersible offshore platform in accordance with the principles described herein.
Figure 14:
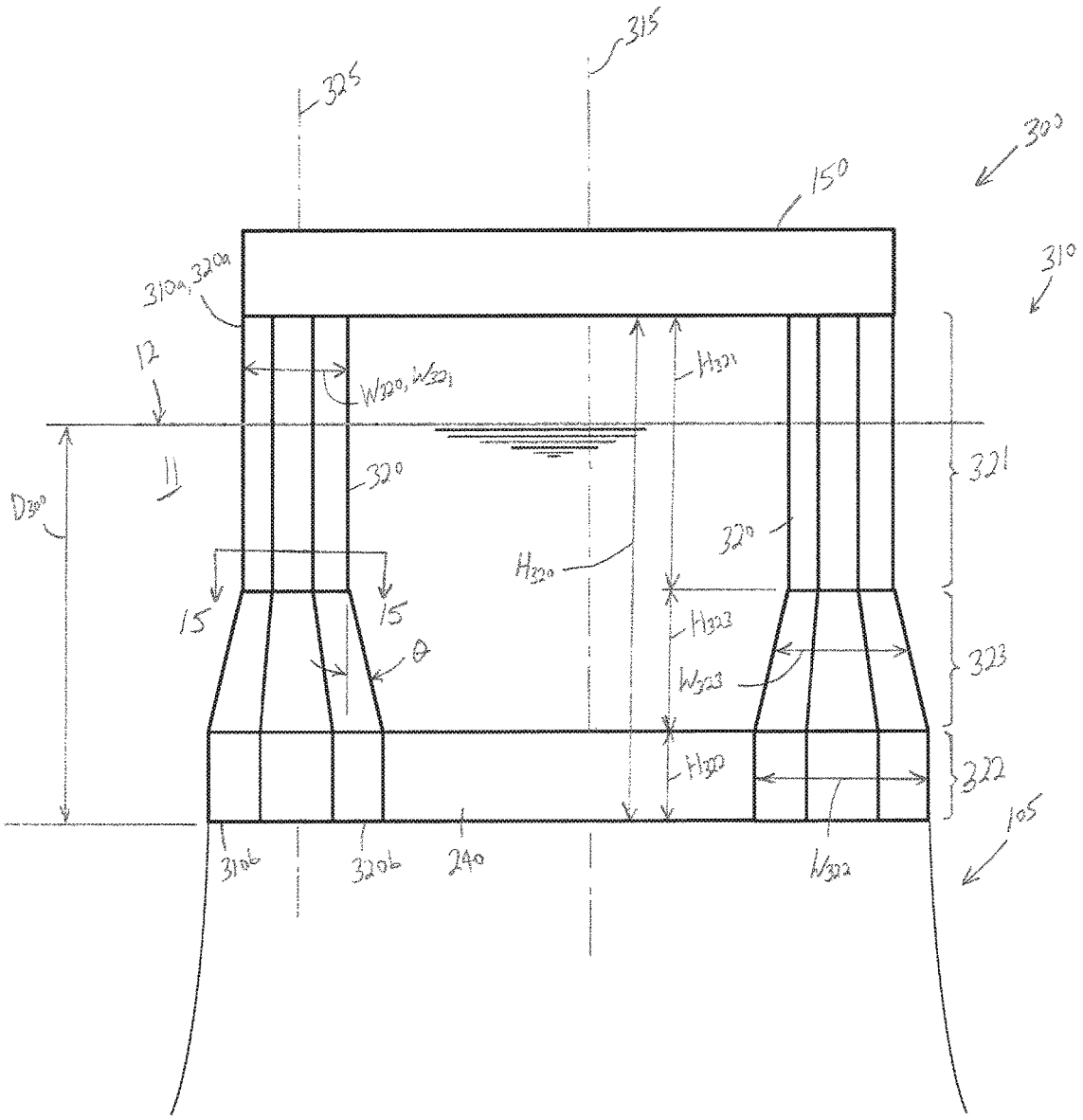
FIG. 14 is a schematic side view of the floating semi-submersible offshore platform of FIG. 13.
Figure 15:
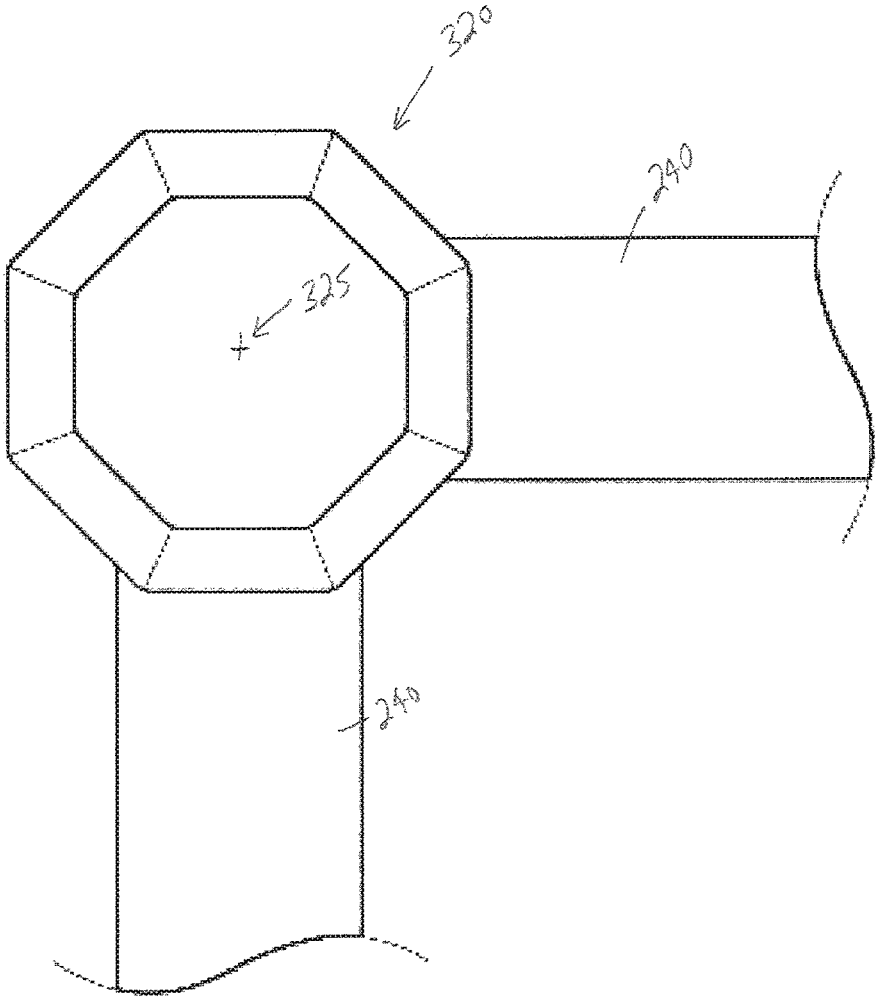
FIG. 15 is an enlarged partial cross-sectional top view of one column of the floating semi-submersible offshore platform of FIG. 14 taken along section 15-15 of FIG. 14.

Referring now to FIGS. 13-15, another embodiment of a floating deep draft semi-submersible offshore structure or platform 300 in accordance with the principles described herein is shown. Platform 300 is substantially the same as platform 200 previously described except for the geometry of the tapered columns. Namely, platform 300 is deployed in a body of water 11 in a deep draft operational configuration and anchored over an operation site with a mooring system 105 as previously described. In addition, platform 300 includes a buoyant hull 310 and a deck or topsides 150 as previously described supported above the surface 12 of water 11 by hull 310. Hull 310 has a vertically oriented central axis 315, an upper end 310*a*, and a lower end 310*b*. Further, platform 300 is deployed at a draft $D_{300}$ measured vertically from the surface 12 to the lower end 310*b* of hull 310. For a deep draft operational deployment, the draft $D_{300}$ is greater than 100 ft., and more preferably between 100 ft. and 200 ft.

Hull 310 includes a plurality of adjustably buoyant elongate columns 320 and a plurality of adjustably buoyant elongate pontoons 240 extending between columns 320. Each column 320 is the same, and each pontoon 240 is as previously described with respect to platform 200. Columns 320 extend vertically between ends 310*a*, 310*b* and are uniformly circumferentially-spaced about axis 315. In addition, each column 320 extends linearly along a vertically oriented straight longitudinal axis 325 between a first or upper end 320*a* disposed at upper end 310*a* of hull 310 and a second or lower end 320*b* disposed at lower end 310*b* of hull 310. Further, each column 320 has a width $W_{320}$ measured perpendicular to axis 325 in side view (i.e., measured horizontally) that generally increases moving downward from upper end 320*a* to lower end 320*b*. Namely, each column 320 has a first or upper section 321 extending axially from upper end 320*a*, a second or lower section 322 extending axially from lower end 320*b*, and an intermediate section 323 extending axially between sections 321, 322. The width $W_{320}$ of column 320 at upper end 320*a* and along the entire upper section 321, also referred to as width $W_{321}$, is constant or uniform moving axially from end 320*a* to intermediate section 323; and the width $W_{320}$ of column 320 at lower end 320*b* and along the entire lower section 322, also referred to as width $W_{322}$, is constant or uniform moving axially from end 320*b* to intermediate section 323. The width $W_{321}$ of upper section 321 is less than the width $W_{322}$ of lower section 322, and thus, the width $W_{320}$ along intermediate section 323, also referred to as width $W_{323}$, increases moving axially from upper section 321 to lower section 322. The width $W_{322}$ along lower section 322 is preferably at least 5% greater than the width $W_{321}$, more preferably 15% to 75% greater than the width $W_{321}$, and even more preferably 25% to 50% greater than the width $W_{321}$. In this embodiment, the width $W_{322}$ of lower section 322 is 31.6% greater than the width $W_{321}$ of upper section 321.

As best shown in FIG. 14, column 320 has a height $H_{320}$ measured axially from upper end 320*a* to lower end 320*b*. To enable deep draft operation deployment, height $H_{320}$ is preferably greater than 100 ft., more preferably between 100 ft. and 300 ft., and even more preferably between 120 ft. and 300 ft. In addition, upper section 321 of column 320 has a height $H_{321}$ measured axially from upper end 320*a* to intermediate section 323, lower section 322 of column 320 has a height $H_{322}$ measured axially from lower end 320*b* to intermediate section 323, and tapered section 323 of column 320 has a height $H_{323}$ measured axially between sections 321, 322. In embodiments described herein, and with respect to the draft $D_{300}$ of platform 300, the height $H_{323}$ of tapered section 323 is preferably at least 5% of the draft $D_{300}$, more preferably at least 15% of the draft $D_{300}$, and even more preferably 30% to 50% of the draft $D_{300}$. In embodiments described herein, and with respect to the total column height $H_{320}$, the height $H_{323}$ of tapered section 323 is preferably at least 2% of the height $H_{320}$, more preferably at least 10% of the height $H_{320}$, and even more preferably 15% to 50% of the height $H_{320}$. In this embodiment, the height $H_{323}$ of tapered section 123 is about 31% of the height $H_{320}$.

Referring now to FIGS. 13-15, unlike columns 120, 220 previously described, which have a square cross-sectional shape in each plane perpendicular to axis 125, 225, respectively, in this embodiment, each column 320 has an octagonal cross-sectional shape in any and all planes oriented perpendicular to axis 325 between ends 320*a*, 320*b*. In particular, each section 321, 322, 323 includes eight outer planar surfaces or sides that intersect at corners that can be rounded or radiused. Upper section 321 includes eight uniformly angularly spaced planar outer sides disposed about axis 325, lower section 322 includes eight uniformly angularly spaced planar outer sides disposed about axis 325, and intermediate section 323 includes eight uniformly angularly spaced planar outer sides disposed about axis 325. Each side of upper section 321 and lower section 322 is vertically oriented, parallel to axis 325. However, each side of intermediate section 323 is sloped. In particular, each side of intermediate section 323 is oriented at an acute slope angle θ relative to axis 325 in side view (i.e., measured upward from axis 325 to the side in side view). In embodiments described herein, the slope angle θ of each sloped side of a column (e.g., each side of intermediate section 323) is preferably between 3° and 60°, more preferably between 3° and 40°, and even more preferably between 5° and 20°. In this embodiment, the slope angle θ of each side of intermediate section 323 is 8.5°.

Figure 16:
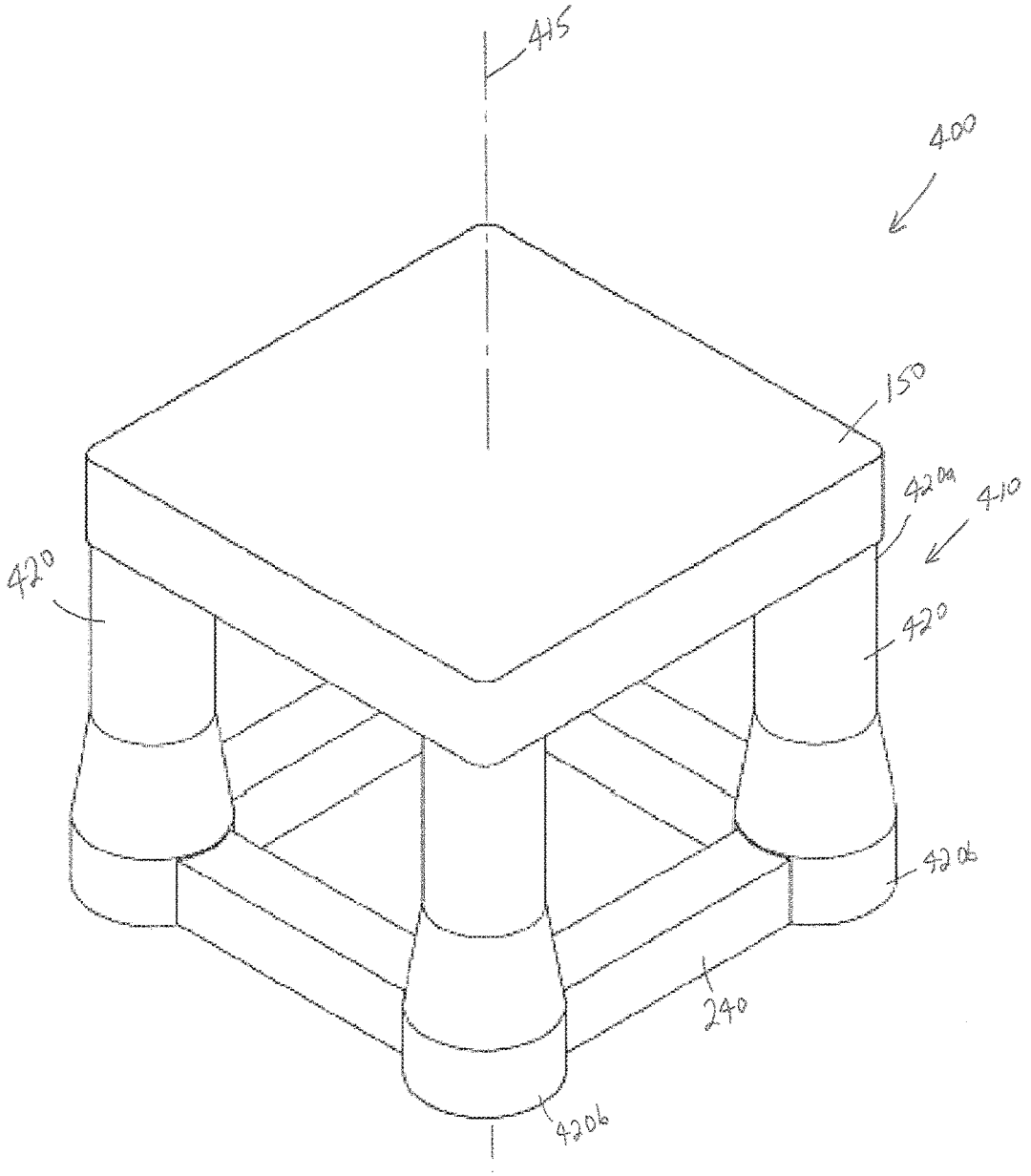
FIG. 16 is a perspective view of an embodiment of a floating semi-submersible offshore platform in accordance with the principles described herein.
Figure 17:
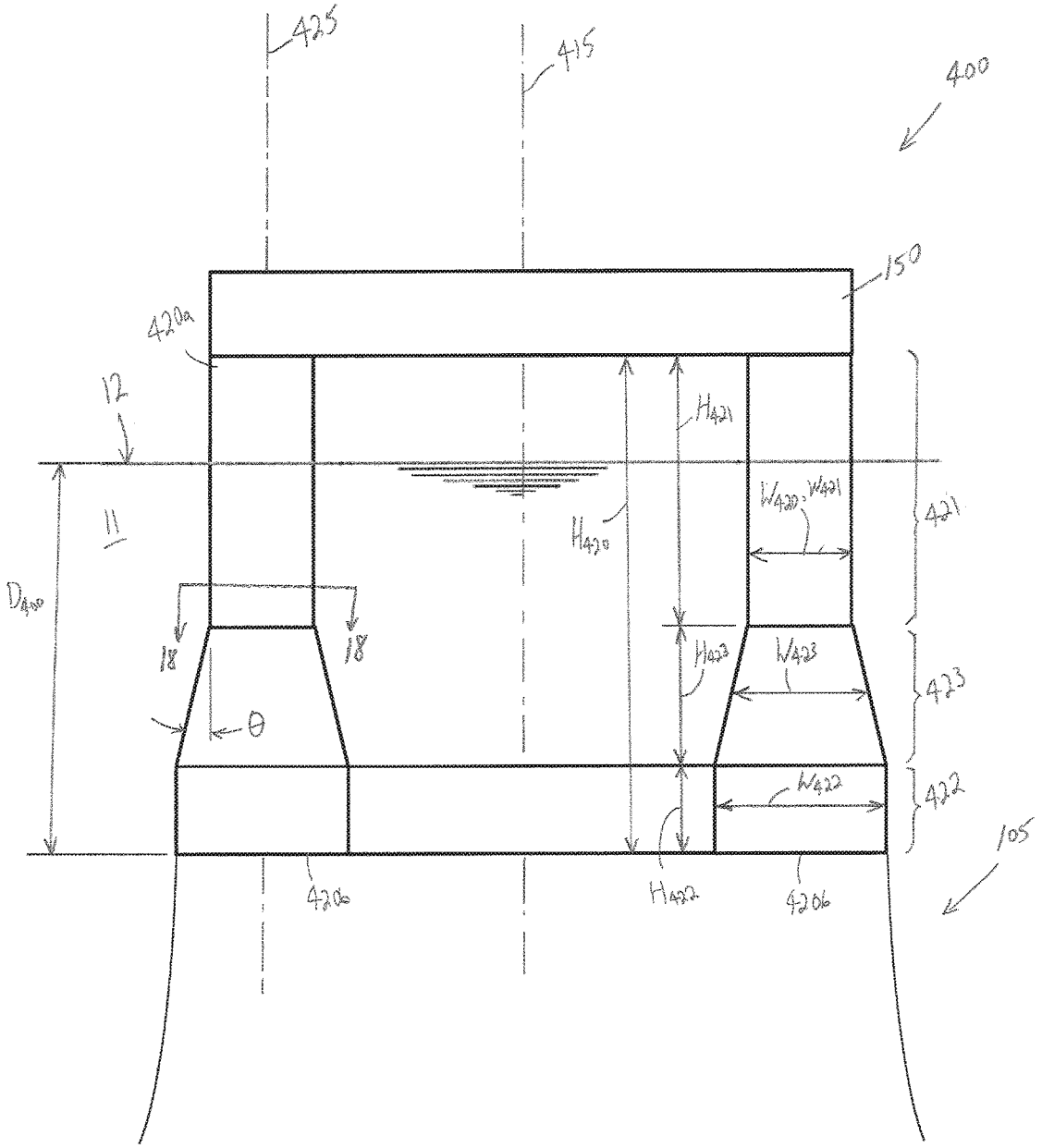
FIG. 17 is a schematic side view of the floating semi-submersible offshore platform of FIG. 13.
Figure 18:
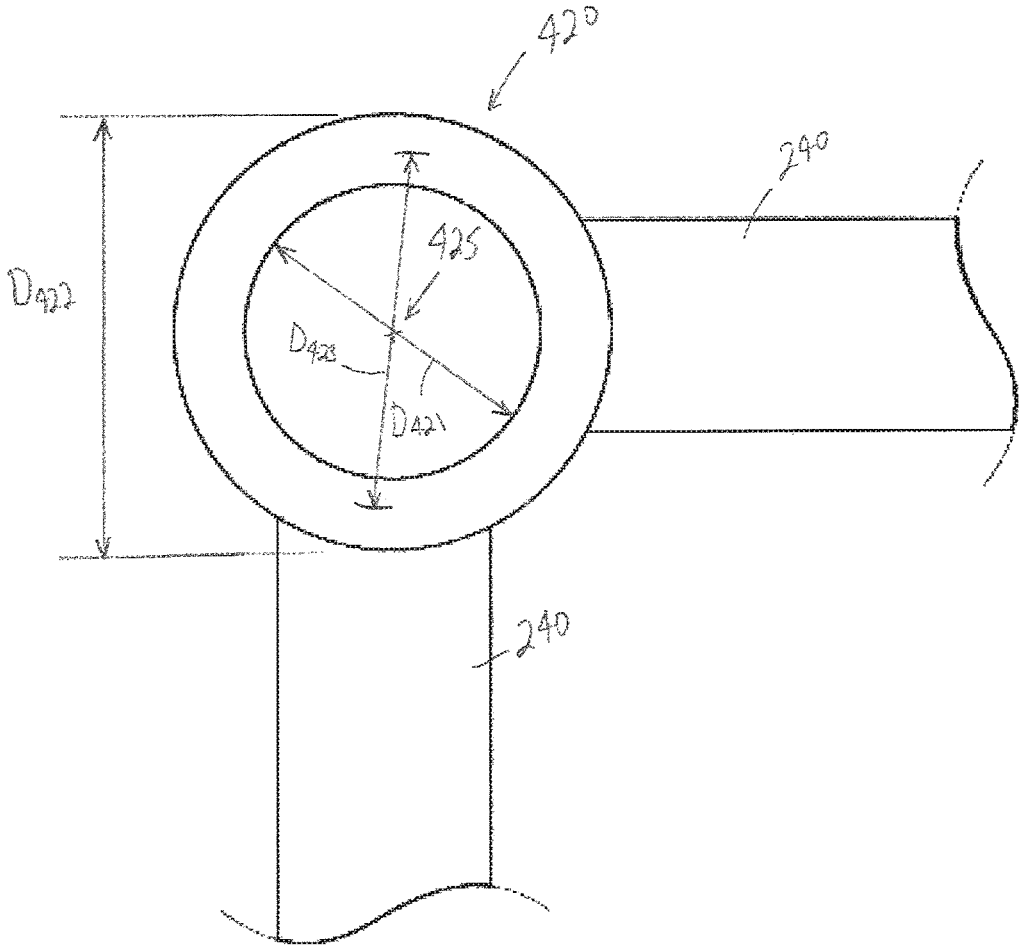
FIG. 18 is an enlarged partial cross-sectional top view of one column of the floating semi-submersible offshore platform of FIG. 17 taken along section 18-18 of FIG. 17.

Referring now to FIGS. 16-18, another embodiment of a floating deep draft semi-submersible offshore structure or platform 400 in accordance with the principles described herein is shown. Platform 400 is substantially the same as platforms 200, 300 previously described except for the geometry of the tapered columns. Namely, platform 400 is deployed in a body of water 11 in a deep draft operational configuration and anchored over an operation site with a mooring system 105 as previously described. In addition, platform 400 includes a buoyant hull 410 and a deck or topsides 150 as previously described supported above the surface 12 of water 11 by hull 410. Hull 410 has a vertically oriented central axis 415, an upper end 410*a*, and a lower end 410*b*. Further, platform 400 is deployed at a draft $D_{400}$ measured vertically from the surface 12 to the lower end 410*b* of hull 410. For a deep draft operational deployment, the draft $D_{400}$ is greater than 100 ft., and more preferably between 100 ft. and 200 ft.

Hull 410 includes a plurality of adjustably buoyant elongate columns 420 and a plurality of adjustably buoyant elongate pontoons 240 extending between columns 420. Pontoons 240 are as previously described with respect to platform 200. Columns 420 extend vertically between ends 410*a*, 410*b* and are uniformly circumferentially-spaced about axis 415. In addition, each column 420 extends linearly along a vertically oriented straight longitudinal axis 425 between a first or upper end 420*a* disposed at upper end 410*a* of hull 410 and a second or lower end 420*b* disposed at lower end 410*b* of hull 410. Further, each column 420 has a width $W_{420}$ measured perpendicular to axis 425 in side view (i.e., measured horizontally) that generally increases moving downward from upper end 420*a* to lower end 420*b*. Namely, each column 420 has a first or upper section 421 extending axially from upper end 420*a*, a second or lower section 422 extending axially from lower end 420*b*, and an intermediate section 423 extending axially between sections 421, 422. The width $W_{420}$ of column 420 at upper end 420*a* and along the entire upper section 421, also referred to as width $W_{421}$, is constant or uniform moving axially from end 420*a* to intermediate section 423; and the width $W_{420}$ of column 420 at lower end 420*b* and along the entire lower section 422, also referred to as width $W_{422}$, is constant or uniform moving axially from end 420*b* to intermediate section 423. The width $W_{421}$ of upper section 421 is less than the width $W_{422}$ of lower section 422, and thus, the width $W_{420}$ along intermediate section 423, also referred to as width $W_{423}$, increases moving axially from upper section 421 to lower section 422. The width $W_{422}$ along lower section 422 is preferably at least 5% greater than the width $W_{421}$, more preferably 15% to 75% greater than the width $W_{421}$, and even more preferably 25% to 50% greater than the width $W_{421}$.

As best shown in FIG. 17, column 420 has a height $H_{420}$ measured axially from upper end 420*a* to lower end 420*b*. To enable deep draft operation deployment, height $H_{420}$ is preferably greater than 100 ft., more preferably between 100 ft. and 300 ft., and even more preferably between 120 ft. and 300 ft. In addition, upper section 421 of column 420 has a height $H_{421}$ measured axially from upper end 420*a* to intermediate section 423, lower section 422 of column 420 has a height $H_{422}$ measured axially from lower end 420*b* to intermediate section 423, and tapered section 423 of column 420 has a height $H_{423}$ measured axially between sections 421, 422. In embodiments described herein, and with respect to the draft $D_{400}$ of platform 400, the height $H_{423}$ of tapered section 423 is preferably at least 5% of the draft $D_{400}$, more preferably at least 15% of the draft $D_{400}$, and even more preferably 30% to 50% of the draft $D_{400}$. In embodiments described herein, and with respect to the total column height $H_{420}$, the height $H_{423}$ of tapered section 423 is preferably at least 2% of the height $H_{420}$, more preferably at least 10% of the height $H_{420}$, and even more preferably 15% to 50% of the height $H_{420}$. In this embodiment, the height $H_{423}$ of tapered section 423 is about 31% of the height $H_{420}$.

Referring now to FIGS. 16-18, unlike columns 120, 220, 320 previously described, which have a multi-sided polygonal cross-sectional shapes, in this embodiment, each column 420 has a circular cross-sectional shape in any and all planes oriented perpendicular to axis 425 between ends 420*a*, 420*b*. In particular, each upper and lower section 421, 422 is cylindrical, and each tapered section 423 is frustoconical. Thus, each section 421, 422 has an outer diameter $D_{421}$, $D_{422}$, respectively, that is equal to the corresponding width $W_{421}$, $W_{422}$, respectively, and each tapered section 423 has an outer diameter $D_{423}$ that is equal to width $W_{423}$ at a given axial position and increases moving axially from section 421 to section 422. In particular, the annular frustoconical outer surface of intermediate section 423 is oriented at an acute slope angle θ relative to axis 425 in side view (i.e., measured upward from axis 425 to the frustoconical surface in side view). In embodiments described herein, the slope angle θ of the sloped frustoconical surface of tapered section 423 is preferably between 3° and 60°, more preferably between 3° and 40°, and even more preferably between 5° and 20°. In this embodiment, the slope angle θ of the frustoconical outer surface of intermediate section 423 is 8.5°.

As previously described, conventional deep draft semi-submersible platforms generally experience less heave motion as compared to shallow draft semi-submersible platforms, but are usually more susceptible to vortex induced-motions (VIM), and present challenges with respect to quayside integration and deployment. However, embodiments of deep draft semi-submersible platforms described herein offer the potential to overcome these shortcomings of conventional deep draft semi-submersible platforms. In particular, embodiments described herein include columns having tapered sections that are disposed above or extend through the surface 12 of the water 11 during quayside integration and deployment, and are disposed below the surface 12 of the water 11 in the operational state (i.e., during drilling and/or production operations).

Regarding quayside integration, the tapered columns (e.g., columns 120, 220, 320 420) results in the lower ends and lower sections of the columns (e.g., ends 120*b*, 220*b*, 320*b*, 420*b*, and lower sections 122, 222, 322, 422) being widened relative to the upper ends and upper sections (e.g., ends 120*a*, 220*a*, 320*a*, 420*a*, and lower sections 121, 221, 321, 421). Consequently, the buoyancy of the lower portion of the hull is increased as compared to a similarly sized conventional hull having columns without widened lower ends. The enhanced buoyancy of the lower portion of the hull enables a reduction in the quayside draft, which may be limited to 30-35 ft. in many shipyards. The enlarged lower portion of the hull also offers the potential to enhance the overall stability of the hull with the limited draft that may be necessary for quayside integration.

Regarding deployment after quayside topside integration, many deep draft semi-submersible platforms are floated from the shipyard to a deeper water location with the pontoons partially submerged, and then ballasted to increase the draft and fully submerge the pontoons below the surface of the water. However, deep draft semi-submersible platforms have relatively long columns, which result in the topsides being disposed at a relatively high height and a relatively high system center of gravity. Ballasting such platforms to increase the draft can present transitional stability challenges as the top of the pontoons submerge below the surface of the water and there is a sudden reduction of the water plane area. However, in embodiments described herein with enlarged lower ends that taper smoothly to narrower upper ends, changes in the water plane area are more gradual (i.e., less abrupt), thereby offering enhanced stability during ballasting and submerging the pontoons below the surface of the water.

Regarding vortex induced-motions (VIM) at the operational site, embodiments described herein including tapered columns offer the potential to reduce VIM by altering the vortex shedding behavior along the long columns of the deep draft semi-submersible platform, and hence reduces the vortex induced motions of the structure. In particular, the tapered columns (i.e., columns having non-uniform widths) offer the potential to interrupt and/or alter the vortex shedding process, thereby keeping the vortex shedding out of sync.

As will be described in more detail in the Examples below, the enlarged lower ends and lower sections of the columns of embodiment described herein, together with utilization of skirt plates, increases the overall displacement and added mass of the hull, which in turn reduces the first hump of the heave motion response amplification operator (RAO) curve and increases the platform heave natural period. A lower first hump of heave motion RAO curve generally helps reduce the wave frequency motions of the platform, and a longer heave natural period away from the typical energy spectra of extreme storms benefits the structure with significantly lower heave resonance motions.

Although embodiments of floating semi-submersible platforms (e.g., platforms 100, 200, 300, 400) disclosed herein are described as "deep draft" because they are generally configured to be deployed at the operational site with a draft greater than 100 ft., it should be appreciated that embodiments of tapered columns used in connection with platforms described herein (e.g., columns 120, 220, 320, 430) can also be used in connection with "shallow draft" floating semi-submersible platforms. For instance, embodiments of tapered columns described herein (e.g., columns 120, 220, 320, 430) can be employed in the hulls of shallow draft floating semi-submersible platforms.

To further illustrate various embodiments described herein, the following example is provided.

EXAMPLE 1

Figure 19:
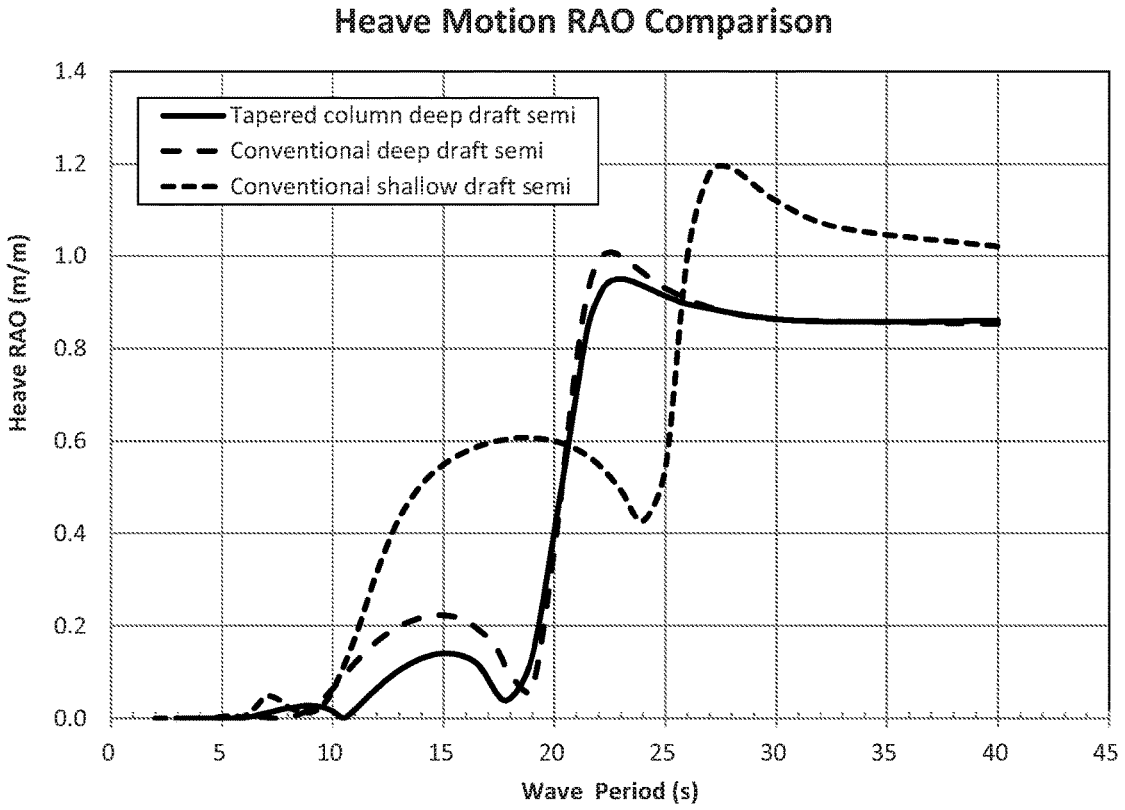
FIG. 19 is a graphical illustration of the heave motion RAO versus wave period for an embodiment of a deep draft floating semi-submersible platform in accordance with the principles herein as compared to a conventional deep draft floating semi-submersible platform and a conventional shallow draft floating semi-submersible platform.

To investigate the impact of the tapered columns in deep draft semi-submersible platforms on heave motion, the motion response of a semi-submersible offshore structure having the shape and geometry of the embodiment of deep draft semi-submersible platform 100 previously described and shown in FIGS. 3 and 4 was modeled using ANSYS® AQWA™ wave diffraction/radiation analysis tool available from ANSYS, Inc. of Canonsburg, Pa., and then compared to a similarly sized and shaped conventional deep draft semi-submersible offshore platform 10 without tapered columns as previously described and shown in FIGS. 1 and 2, and a conventional shallow draft semi-submersible offshore platform 10 without tapered columns as previously described and shown in FIGS. 1 and 2. In particular, the heave Response Amplitude Operator (RAO) of a deep draft platform 100 was compared with deep draft platform 10 and the shallow draft platform 10. As is known in the art, heave RAO is directly related to the expected heave motion of an offshore structure. Deep draft platforms 10, 100 were modeled at a 160 ft. draft, and the shallow draft platform 10 was modeled at 95 ft. draft. A comparison of the heave motion RAOs (heave amplitude per unit wave elevation) as a function of wave period (seconds) of the three platforms is shown in FIG. 19. In general, the tapered column deep draft semi-submersible platform 100 exhibited similar or lower heave response (i.e., heave motion RAO) than the conventional deep draft semi-submersible platform 10 and the conventional shallow draft semi-submersible platform 10 for all wave periods less than about 20 seconds. It should be noted that the tapered column deep draft semi-submersible platform 100 exhibited significantly lower heave response as compared to the conventional shallow draft semi-submersible platform 10. The first peak for the heave RAO of the deep draft semi-submersible platform 100 was less than 0.2, whereas the first peak for the heave ROA of the conventional deep draft semi-submersible platform 10 and the conventional shallow draft semi-submersible platform 10 were above 0.2.

EXAMPLE 2

Figure 20:
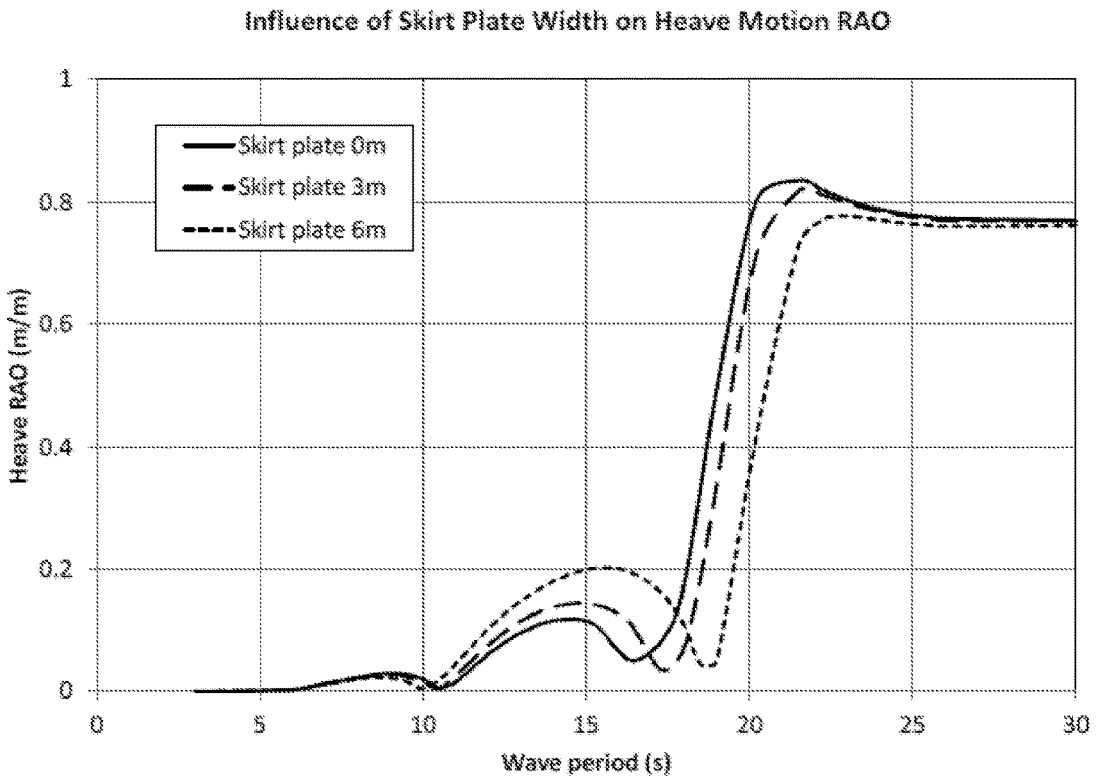
FIG. 20 is a graphical illustration of the heave motion RAO versus wave period for an embodiment of a deep draft floating semi-submersible platform having different sized horizontal skirt plates.

To investigate the impact of horizontal skirt plates having different widths on heave motion, the motion response of a semi-submersible offshore structure having the shape and geometry of the embodiment of deep draft semi-submersible platform 100 previously described and shown in FIGS. 3 and 4 without horizontal skirt plates 170 was modeled using ANSYS® AQWA™ wave diffraction/radiation analysis tool available from ANSYS, Inc. of Canonsburg, Pa., and then compared to the same deep draft semi-submersible platform 100 including (i) horizontal skirt plates 170 having widths $W_{170}$ of 3.0 m mounted to the lower inside surface of each pontoon 140 as previously described and shown in FIG. 8 and (ii) horizontal skirt plates 170 having widths $W_{170}$ of 6.0 m mounted to the lower inside surface of each pontoon 140 as previously described and shown in FIG. 8. In particular, the heave Response Amplitude Operator (RAO) of each deep draft platform 100 including horizontal skirt plates 170 was compared with deep draft platform 100 without any horizontal skirt plates 170 for a given wave spectrum. Each deep draft platform 100 was modeled at a 160 ft. draft. A comparison of the heave motion RAOs (heave amplitude per unit wave elevation) as a function of wave period (seconds) of the three deep draft semi-submersible platforms 100 is shown in FIG. 20. In general, inclusion of horizontal skirt plates 170, and further, the width $W_{170}$ of the horizontal skirt plates 170 influenced both the magnitude of the first hump of the heave RAO curves and the frequency of the second peak of the heave RAO. FIG. 20 illustrates that horizontal skirt plates 170 affect the responses of deep draft platforms 100 to wave actions. In general, skirt plates 170 having a larger width $W_{170}$ provided higher added mass in the vertical direction, which in turn shifted the heave natural period upward. On the other hand, skirt plates 170 having a larger width $W_{170}$ also generate more wave forces which increase the first hump of the heave RAO curves around 15 seconds. By carefully selecting the widths $W_{170}$ of the horizontal skirt plates 170, the design of the deep draft platforms (e.g., platform 100) can be optimized to minimize and/or avoid resonance heave motions within wave energy spectra, while keep wave frequency heave motions RAOs at acceptable levels.

EXAMPLE 3

Figure 21:
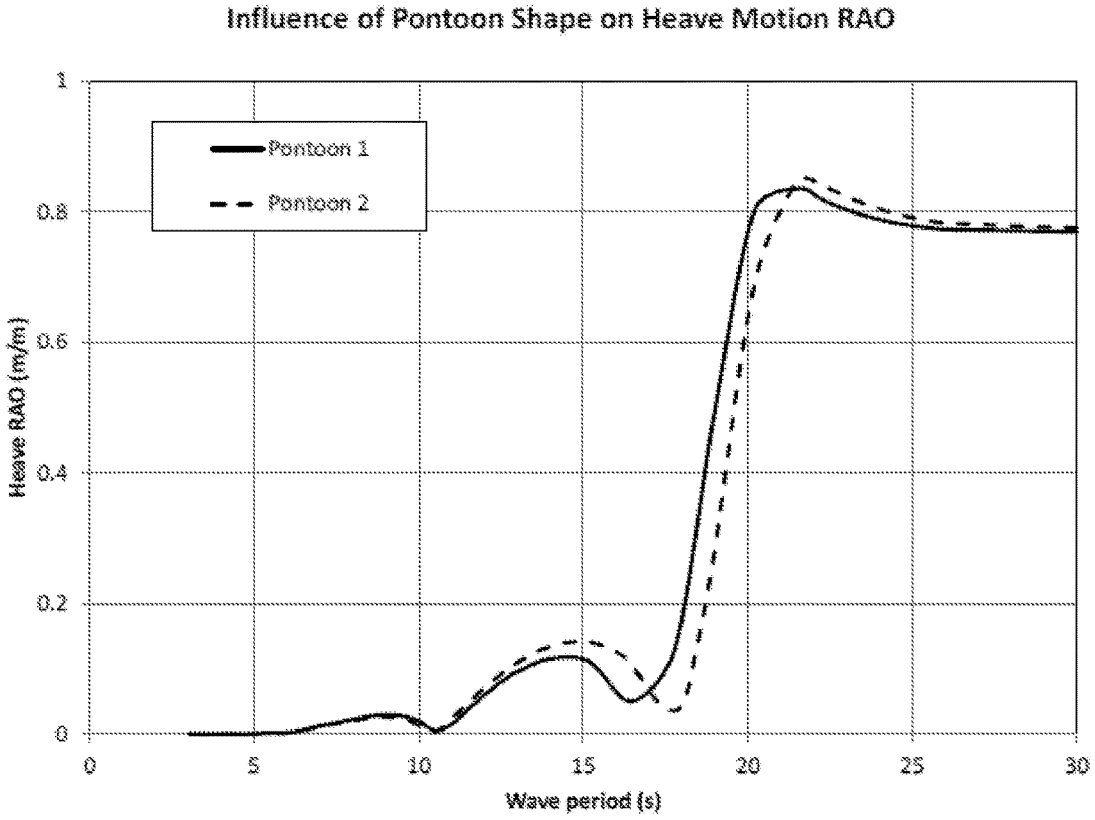
FIG. 21 is a graphical illustration of the heave motion RAO versus wave period for an embodiment of a deep draft floating semi-submersible platform having different pontoon geometries.

To investigate the impact of the geometry of the horizontal pontoons on heave motion, the motion response of a semi-submersible offshore structure having the shape and geometry of the embodiment of deep draft semi-submersible platform 100 previously described and shown in FIGS. 3 and 4 was modeled using ANSYS® AQWA™ wave diffraction/radiation analysis tool available from ANSYS, Inc. of Canonsburg, Pa. with pontoons 140 having widths $W_{140}$ of 29.36 ft. and heights $H_{140}$ of 39.37 ft. (labeled "Pontoon 1" in FIG. 21), and then compared to the same platform 100 with pontoons 140 having widths $W_{140}$ of 37.73 ft. and heights $H_{140}$ of 29.53 ft. (labeled "Pontoon 2" in FIG. 21). Each deep draft platform 100 was modeled at a 160 ft. draft. A comparison of the heave motion RAOs (heave amplitude per unit wave elevation) as a function of wave period (seconds) of the two deep draft semi-submersible platforms 100 is shown in FIG. 21. In general, width $W_{140}$ and height $H_{140}$ of the pontoons 140 impacted the heave RAO of the platform 100. The motion RAO curves show that the combination of different pontoon widths $W_{140}$ and pontoon heights $H_{140}$ affects the platform heave motion performance. In particular, FIG. 21 illustrates that pontoons 140 having a larger width $W_{140}$ provide similar functions as skirt plates (e.g., skirt plates 170) with respect to affecting the heave motion RAO and natural period.

EXAMPLE 4

Figure 22:
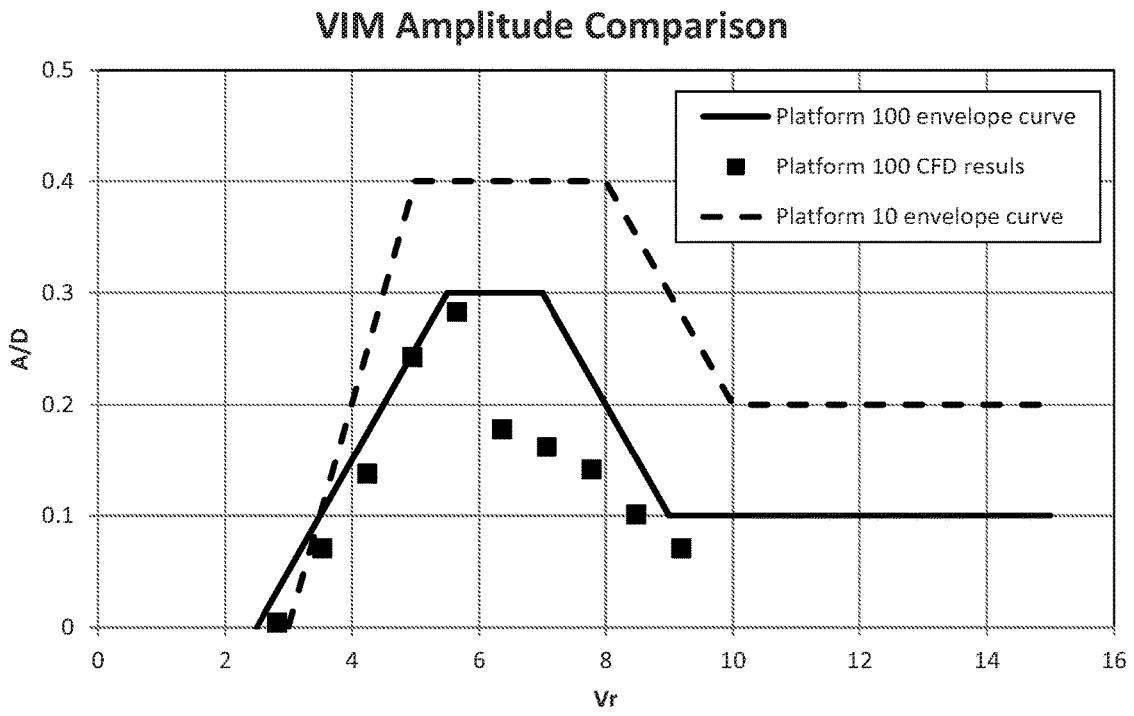
FIG. 22 is a graphical illustration of the VIM amplitude versus Vr for an embodiment of a deep draft floating semi-submersible platform in accordance with the principles herein as compared to a conventional deep draft floating semi-submersible.

To investigate the impact of the tapered columns in deep draft semi-submersible platforms on heave motion, the vortex induced motion (VIM) amplitude of a semi-submersible offshore structure having the shape and geometry of the embodiment of deep draft semi-submersible platform 100 previously described and shown in FIGS. 3 and 4 were calculated using STAR-CCM+CFD software tools and compared to published model test data of a similarly sized and shaped conventional deep draft semi-submersible offshore platform without tapered columns (e.g., platform 10 as previously described and shown in FIGS. 1 and 2). Deep draft platform 100 was modeled at a 160 ft. draft, and the conventional deep draft semi-submersible offshore platform disclosed in the published model test data had a 150 ft. to 160 ft. draft. A comparison of the VIM amplitude (A) divided by characteristic dimension of the column (D) (typically the width of the column) as a function of the reduced velocity (Vr) of the platform 100 and the conventional deep draft semi-submersible offshore platform is shown in FIG. 22. As is known in the art, reduced velocity (Vr)=U/(f*D), where "U" is the current velocity, "f" is the natural frequency of the system, and "D" is the characteristic dimension of the column (typically the width of the column).

In this analysis, the characteristic dimension was defined as the width one upper column projected in the same direction as the current flow. As shown in FIG. 22, the VIM amplitude of tapered column deep draft semi-submersible platform 100 was significantly lower than that of the conventional deep draft semi-submersible platform 10. Without being limited by this or any particular theory, when a relatively strong current passes a semi-submersible hull, vortices are usually created behind the columns. When the vortex shedding frequency is close to the natural frequency of the platform and mooring system, resonance or lock-in often occurs. The vortex shedding frequency is function of current speed, column size, and geometry. However, embodiments of platforms described herein having tapered columns alter the possible vortex shedding frequency along the column, and in turn reduces the possibility of lock-in occurrence, and eventually reduces the amplitude of VIM when resonance motion occurs.

While preferred embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A semi-submersible offshore platform for operations in a body of water, comprising:

a buoyant hull configured to be at least partially submerged in the water;

an equipment deck coupled to the hull and configured to be positioned above the water;

wherein the hull comprises:

a first vertical column and a second vertical column horizontally spaced from the first vertical column, wherein each column has a longitudinal axis, an upper end configured to be disposed above the water, and a lower end configured to be submerged in the water;

a horizontal pontoon having a longitudinal axis, a first end coupled to the lower end of the first column, and a second end coupled to the lower end of the second column;

wherein each column includes an upper section, a lower section, and a tapered section positioned between the upper section and the lower section, wherein the upper section extends axially downward from the upper end to the tapered section and the lower section extends axially upward from the lower end to the tapered section, wherein the upper section of each column has a width $W_1$ measured perpendicular to the longitudinal axis of the column in side view, the lower section of each column has a width $W_2$ measured perpendicular to the longitudinal axis of the column in side view, and the tapered section of each column has a width $W_3$ measured perpendicular to the longitudinal axis of the column in side view wherein the width $W_1$ of the upper section is less than the width $W_2$ of the lower section, and wherein the width $W_3$ of the tapered section increases from the width $W_1$ to the width $W_2$ moving axially downward along the tapered section from the upper section to the lower section; and wherein the width $W_2$ of each lower section is 25% to 50% larger than the width $W_1$ of each upper section.

2. The platform of claim 1, wherein the width $W_1$ of the upper section is uniform moving axially downward from the upper end to the tapered section;

wherein the width $W_2$ of the lower section is uniform moving axially upward from the lower end to the tapered section.

3. The platform of claim 1, wherein each column has a height $H_1$ measured vertically from the lower end to the upper end of the column, wherein the height $H_1$ of each column is greater than 100 ft.; and wherein the tapered section of each column has a height $H_2$ measured vertically from a lower end of the tapered section to an upper end of the tapered section;

wherein the height $H_2$ of each tapered section is at least 2% of the height $H_1$ of the corresponding column.

4. The platform of claim 3, wherein the height $H_2$ of each tapered section is 15% to 50% of the height $H_1$ of the corresponding column.

5. The platform of claim 3, wherein the buoyant hull is configured to be deployed in the water at a deep draft $D_1$;

wherein the height $H_2$ of each tapered section is at least 5% of the deep draft $D_1$.

6. The platform of claim 5, wherein the height $H_2$ of each tapered section is 30% to 50% of the draft $D_1$.

7. The platform of claim 5, wherein a distance from the lower end of each column to an upper end of the tapered section is less than the deep draft $D_1$.

8. The platform of claim 1, wherein the first end of the pontoon is attached to a portion of the lower section of the first column that is axially adjacent the tapered section of the first column and the second end of the pontoon is attached to a portion of the lower section of the second column that is axially adjacent the tapered section of the second column.

9. The platform of claim 1, wherein the lower section of each column has a height $H_3$ measured vertically from the lower end of the column to the tapered section of the column;

wherein the pontoon has a height $H_4$ measured vertically from a bottom of the pontoon to a top of the pontoon;

wherein the height $H_3$ is the same as the height $H_4$.

10. The platform of claim 1, wherein each column has a polygon or a circular cross-sectional shape in a plane perpendicular to the longitudinal axis of the column.

11. The platform of claim 1, wherein the tapered section of each column has an outer surface oriented at an acute angle θ measured from the longitudinal axis of the column in side view, wherein the acute angle θ is between 3° and 60°.

12. The platform of claim 11, wherein the outer surface of the tapered section of each column oriented at the acute angle θ is a planar surface or a frustoconical surface.

13. The platform of claim 1, further comprising a horizontal skirt plate coupled to the pontoon;

wherein the pontoon has a width $W_4$ measured perpendicular to the longitudinal axis of the pontoon in top view and the horizontal skirt plate has a width $W_5$ measured horizontally from the pontoon; and wherein the width $W_5$ is less than 200% the width $W_4$.

14. The platform of claim 1, further comprising a vertical skirt plate coupled to the pontoon;

wherein the pontoon has a height $H_p$ measured perpendicular to the longitudinal axis of the pontoon in side view and the vertical skirt plate has a height $H_s$ measured vertically from the pontoon; and wherein the height $H_s$ is less than the height $H_p$.

15. A semi-submersible offshore platform for drilling or production operations in a body of water, comprising:

a buoyant hull having a vertical central axis and configured to be at least partially submerged in the water at a deep draft $D_1$;

an equipment deck coupled to the hull and configured to be positioned above the water;

wherein the hull comprises:

a plurality of circumferentially spaced vertical columns disposed about the central axis of the hull, wherein each column has a longitudinal axis, an upper end, and a lower end;

a plurality of horizontal pontoons, wherein one pontoon extends between the lower ends of each pair of circumferentially adjacent columns;

wherein each column includes an upper section, a lower section, and a tapered section positioned between the upper section and the lower section, wherein the upper section extends axially downward from the upper end to the tapered section and the lower section extends axially upward from the lower end to the tapered section, wherein the upper section of each column has a width $W_1$ measured perpendicular to the longitudinal axis of the column in side view, the lower section of each column has a width $W_2$ measured perpendicular to the longitudinal axis of the column in side view, and the tapered section of each column has a width $W_3$ measured perpendicular to the longitudinal axis of the column in side view;

wherein the width $W_1$ of the upper section is less than the width $W_2$ of the lower section, and wherein the width $W_3$ of the tapered section increases from the width $W_1$ to the width $W_2$ moving axially downward along the tapered section from the upper section to the lower section; and wherein a distance measured vertically from the lower end of each column to an upper end of each tapered section is less than the deep draft $D_1$.

16. The platform of claim 15, wherein each column has a height $H_1$ measured vertically from the lower end to the upper end of the column, wherein the height $H_1$ of each column is greater than 100 ft.; and wherein the tapered section of each column has a height $H_2$ measured vertically from a lower end of the tapered section to an upper end of the tapered section;

wherein the height $H_2$ of each tapered section is at least 2% of the height $H_1$ of the corresponding column.

17. The platform of claim 16, wherein the height $H_2$ of each tapered section is 15% to 50% of the height $H_1$ of the corresponding column.

18. The platform of claim 16, wherein the height $H_2$ of each tapered section is 30% to 50% of the draft $D_1$.

19. The platform of claim 15, wherein the lower section of each column has a height $H_3$ measured vertically from the lower end of the column to the tapered section of the column;

wherein each pontoon has a height $H_4$ measured vertically from a bottom of the pontoon to a top of the pontoon;

wherein the height $H_3$ is the same as the height $H_4$.

20. The platform of claim 15, wherein the plurality of pontoons includes a first pontoon;

wherein the plurality of columns includes a first column and a second column;

wherein a first end of the first pontoon is attached to a portion of the lower section of the first column axially adjacent the tapered section of the first column and a second end of the first pontoon is attached to a portion of the lower section of the second column axially adjacent the tapered section of the second column.

21. The platform of claim 15, wherein the tapered section of each column has an outer surface oriented at an acute angle θ measured from the longitudinal axis of the column in side view, wherein the acute angle θ is between 3° and 60°.

22. The platform of claim 15, further comprising a horizontal skirt plate or a vertical skirt plate coupled to each pontoon.

* * * * *